US007244551B2

(12) United States Patent
Hosokawa et al.

(10) Patent No.: US 7,244,551 B2
(45) Date of Patent: Jul. 17, 2007

(54) SILVER HALIDE COLOR PHOTOSENSITIVE MATERIAL

(75) Inventors: Junichiro Hosokawa, Minamiashigara (JP); Naoharu Kiyoto, Minamiashigara (JP); Ryoji Nishimura, Minamiashigara (JP); Takashi Hoshimiya, Minamiashigara (JP); Tadashi Inaba, Minamiashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/315,092

(22) Filed: Dec. 23, 2005

(65) Prior Publication Data

US 2006/0141401 A1 Jun. 29, 2006

(30) Foreign Application Priority Data

Dec. 27, 2004 (JP) ..... 2004-378310

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/505; 430/502; 430/543; 430/552; 430/553; 430/554; 430/555; 430/558; 430/556; 430/557; 430/544; 430/955

(58) Field of Classification Search ..... 430/502, 430/505, 543, 552–553, 554–555, 556–557, 430/558, 544, 955

See application file for complete search history.

(56) References Cited

U.S. PATENT DOCUMENTS

| | | | | |
|---|---|---|---|---|
| 6,495,313 | B1 * | 12/2002 | Yoshioka et al. | 430/558 |
| 6,936,412 | B2 * | 8/2005 | Abe | 430/558 |
| 6,949,332 | B2 * | 9/2005 | Kawakami et al. | 430/546 |
| 2005/0214696 | A1 * | 9/2005 | Hosokawa et al. | 430/502 |

* cited by examiner

*Primary Examiner*—Geraldina Visconti
(74) *Attorney, Agent, or Firm*—Sughrue Mion, PLLC

(57) ABSTRACT

A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one non-sensitive layer, wherein compound (A) is contained in at least one layer in the silver halide color photosensitive material, compound (A) being a compound capable of releasing compound (Ac1) by oxidation coupling reaction with a color developing agent, compound (Ac1) being a heterocyclic compound which when added, is capable of enhancing the sensitivity of the photosensitive material as compared with that exhibited when not added, provided that the heterocyclic ring of the heterocyclic compound has 1 or 2 hetero atoms.

8 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2004-378310, filed Dec. 27, 2004, the entire contents of which are incorporated herein by reference.

BACKGROUND OF THE INVENTION

1. Field of the Invention

The present invention relates to a silver halide color photosensitive material. More specifically, the present invention relates to a silver halide color photosensitive material with high sensitivity minimal in graininess and excellent in storability.

2. Description of the Related Art

For a long time there has been a desire to make a silver halide color photosensitive material highly sensitive without increasing graininess. In general, sensitivity is dependent on the size of silver halide emulsion grains. The larger the emulsion grain, the greater the sensitivity is. However, since the graininess is increased in accordance with the increase in the size of the silver halide emulsion grains, there is a trade-off between sensitivity and graininess. In the industry, it is the most basic and important matter from the viewpoint of improving the image quality of a photosensitive material to increase the sensitivity without increasing the graininess.

There has been disclosed a technique of increasing the sensitivity without increasing the graininess by containing a compound having at least three hetero atoms in a silver halide color photosensitive material (see, for example, Jpn. Pat. Appln. KOKAI Publication No. (hereinafter referred to as JP-A-)2000-194085, JP-A-2003-156823 and JP-A-2004-226971).

In contact, the present inventors have found that a compound having one or two hetero atoms obtains preferably better effect for improving the sensitivity than the above-mentioned compound at least of three hetero atoms and have extensively studied Improvement.

However, although the increase in sensitivity is obtained by the above-mentioned method, it has been clarified that the storability of a raw photosensitive material is occasionally degraded extremely. In particular, the storability of a photosensitive material in an environment of high temperature and low humidity such as the inside of an automobile left alone in the sun, occasionally a serious situation provokes, and it has been clarified that fog increase and sensitivity decrease are problems when the material is left alone at a temperature of 80° C. or more and a humidity of 10% or less.

BRIEF SUMMARY OF THE INVENTION

It is the purpose of the present invention to improve the above-mentioned problems and to provide a silver halide color photosensitive material capable of increasing sensitivity without degrading the storability of the silver halide photosensitive material.

The present inventors have found that the above-mentioned problems can be solved by the means below.

Namely, the present invention provides the following silver halide color photosensitive material.

(1) A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one non-sensitive layer, wherein compound (A) is contained in at least one layer in the silver halide color photosensitive material, compound (A) being a compound capable of releasing compound (Ac1) by oxidation coupling reaction with a color developing agent, compound (Ac1) being a heterocyclic compound which when added, is capable of enhancing the sensitivity of the photosensitive material as compared with that exhibited when not added, provided that the heterocyclic ring of the heterocyclic compound has 1 or 2 hetero atoms.

(2) The silver halide color photosensitive material according to item (1) above, wherein compound (A) is an active methylene compound, a pyrazolone compound, a pyrazoloazole compound, a phenol compound, a naphthol compound or a pyrrolotriazole compound.

(3) The silver halide color photosensitive material according to item (1) or (2) above, wherein the heterocyclic ring of compound (Ac1) is an imidazole ring.

(4) The silver halide color photosensitive material according to any one of items (1) to (3) above, wherein a compound selected from the following type 1 and the type 2 is contained in at least one layer in the photosensitive material.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

DETAILED DESCRIPTION OF THE INVENTION

Compound (A) of the present invention will be described in detail below.

In the present invention, when any specified moiety is referred to as "group", it is meant that the moiety per se may be unsubstituted or have one or more (up to possible largest number) substituents. For example, the "alkyl group" refers to a substituted or unsubstituted alkyl group. She substituents which can be employed in the compounds of the present invention are not limited irrespective of the existence of substitution.

When these substituents are referred to as Wa, the substituents represented by Wa are not particularly limited. As such, there can be mentioned, for example, halogen atoms, alkyl groups (including a cycloalkyl group, a bicycloalkyl group and a tricycloalkyl group), alkenyl groups (including a cycloalkenyl group and a bicycloalkenyl group), alkynyl groups, aryl groups, heterocyclic groups, a cyano group, a hydroxyl group, a nitro group, a carboxyl group, alkoxy groups, aryloxy groups, a silyloxy group, heterocyclic oxy groups, acyloxy groups, a carbamoyloxy group, alkoxycarbonyloxy groups, aryloxycarbonyloxy groups, amino groups (including alkylamino groups, arylamino groups and heterocyclic amino groups), an ammonia group, acylamino groups, an aminocarbonylamino group, alkoxycarbonylamino groups, aryloxycarbonylamino groups, a sulfamoylamino group, alkyl- or arylsulfonylamino group, a mercapto group, alkylthio groups, arylthio groups, heterocyclic thio groups, a sulfamoyl group, a sulfo group, alkyl- or arylsulfinyl groups, alkyl- or arylsulfonyl groups, acyl groups, aryloxycarbonyl groups, alkoxycarbonyl groups, a carbamoyl group, aryl- or heterocyclic azo groups, an imido group, a phosphino group, a phosphinyl group, a phosphinyloxy group, a phosphinylamino group, a phosphono group, a silyl group, a hydrazino group, a ureido group, a borate group (—$S(OH)_2$), a phosphato group (—$OPO(OH)_2$), a sulfato group (—$OSO_3H$) and other common substituents.

More specifically, Wa can represent any of halogen atoms (e.g., a fluorine atom, a chlorine atom, a bromine atom and an iodine atom); alkyl groups [each being a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, alkyl of alkylthio group) means the alkyl group of this concept, which however further includes an alkenyl group and an alkynyl group]; alkenyl groups [each being a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)); alkynyl groups (preferably a substituted or unsubstituted alkynyl group having 2 to 30 carbon atoms, such as ethynyl, propargyl or trimethylsilylethynyl); aryl groups (preferably a substituted or unsubstituted aryl group having 6 to 30 carbon atoms, such as phenyl, p-tolyl, naphthyl, m-chlorophenyl or o-hexadecanoylaminophenyl); heterocyclic groups (preferably a monovalent group corresponding to a 5- or 6-membered substituted or unsubstituted aromatic or nonaromatic heterocyclic compound from which one hydrogen atom is removed (the monovalent group may be condensed with a benzene ring, etc.), more preferably a 5- or 6-membered aromatic heterocyclic group having 3 to 30 carbon atoms, such as 2-furyl, 2-thienyl, 2-pyrimidinyl or 2-benzothiazolyl (the heterocyclic group may be a cationic heterocyclic group such as 1-methyl-2-pyridinio or 1-methyl-2-quinolinio)); a cyano group; a hydroxyl group; a nitro group; a carboxyl group; alkoxy groups (preferably a substituted or unsubstituted alkoxy group having 1 to 30 carbon atoms, such as methoxy, ethoxy, isopropoxy, t-butoxy, n-octyloxy or 2-methoxyethoxy); aryloxy groups (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); silyloxy groups (preferably a silyloxy group having 3 to 20 carbon atoms, such as trimethylsilyloxy or t-butyldimethylsilyloxy); heterocyclic oxy groups (preferably a substituted or unsubstituted heterocyclic oxy group having 2 to 30 carbon atoms, such as 1-phenyltetrazol-5-oxy or 2-tetrahydropyranyloxy); acyloxy groups (preferably a formyloxy group, a substituted or unsubstituted alkylcarbonyloxy group having 2 to 30 carbon atoms or a substituted or unsubstituted arylcarbonyloxy group having 7 to 30 carbon atoms, such as formyloxy, acetyloxy, pivaloyloxy, stearoyloxy, benzoyloxy or p-methoxyphenylcarbonyloxy); carbamoyloxy groups (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); alkoxycarbonyloxy groups (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); aryloxycarbonyloxy groups (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); amino groups (preferably an amino group, a substituted or unsubstituted alkylamino group having 1 to 30 carbon atoms or a substituted or unsubstituted arylamino group having 6 to 30 carbon atoms, such as amino, methylamino, dimethylamino, anilino, N-methylanilino or diphenylamino); ammonio groups (preferably an ammonio group or an ammonio group substituted with a substituted or unsubstituted alkyl, aryl or heterocycle having 1 to 30 carbon atoms, such as trimethylamitionio, triethylammonio or diphenylmethylammonio), acylamino groups (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); aminocarbonylamino groups (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); alkoxycarbonylamino groups (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methyl-methoxycarbonylamino); aryloxycarbonylamino groups (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); sulfamoylamino groups (preferably a substituted or unsubstituted sulfamoylamino group having 0 to 30 carbon atoms, such as sulfamoylamino, N,N-dimethylaminosulfonylamino or N-n-octylaminosulfonylamino); alkyl- or arylsulfonylamino groups (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; alkylthio groups (preferably a substituted or unsubstituted alkylthio group having 1 to 30 carbon atoms, such as methylthio, ethylthio or n-hexadecylthio);

arylthio groups (preferably a substituted or unsubstituted arylthio group having 6 to 30 carbon atoms, such as phenylthio, p-chlorophenylthio or m-methoxyphenylthio); heterocyclic thio groups (preferably a substituted or unsubstituted heterocyclic thio group having 2 to 30 carbon atoms, such as 2-benzothiazolylthio or 1-phenyltetrazol-5-ylthio); sulfamoyl groups (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; alkyl- or arylsulfinyl groups (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); alkyl- or arylsulfonyl groups (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsalfonyl); acyl groups (preferably a formyl group, a substituted or unsubstituted alkylcarbonyl group having 2 to 30 carbon atoms, a substituted or unsubstituted arylcarbonyl group having 7 to 30 carbon atoms or a substituted or unsubstituted heterocyclic carbonyl group having 4 to 30 carbon atoms wherein carbonyl is bonded with carbon atom thereof, such as acetyl, pivaloyl, 2-chloroacetyl, stearoyl, benzoyl, p-n-octyloxyphenylcarbonyl, 2-pyridylcarbonyl or 2-furylcarbonyl); aryloxycarbonyl groups (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); alkoxycarbonyl groups (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); carbamoyl groups (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); aryl- or heterocyclic azo groups (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); imido groups (preferably N-succinimido or N-phthalimido); phosphino groups (preferably a substituted or unsubstituted phosphino group having 2 to 30 carbon atoms, such as dimethylphosphino, diphenylphosphino or methylphenoxyphosphino); phosphinyl groups (preferably a substituted or unsubstituted phosphinyl group having 2 to 30 carbon atoms, such as phosphinyl, dioctyloxyphosphinyl or diethoxyphosphinyl); phosphinyloxy groups (preferably a substituted or unsubstituted phosphinyloxy group having 2 to 30 carbon atoms, such as diphenoxyphosphinyloxy or dioctyloxyphosphinyloxy); phosphinylamino groups (preferably a substituted or unsubstituted phosphinylamino group having 2 to 30 carbon atoms, such as dimethoxyphosphinylamino or dimethylaminophospninylamino); a phospho group; silyl groups (preferably a substituted or unsubstituted silyl group having 3 to 30 carbon atoms, such as trimethylsilyl, t-butyldimethylsilyl or phenyldimethylsilyl); hydrazino groups (preferably a substituted or unsubstituted hydrazino group having 0 to 30 carbon atoms, such as trimethylhydrazino); and ureldo groups (preferably a substituted or unsubstituted ureido group having 0 to 30 carbon atoms, such as N,N-dimethylureido)

Two Wa's can cooperate with each other to thereby form a ring (any of aromatic or nonaromatic hydrocarbon rings and heterocycles (these can be combined into polycyclic condensed rings), for example, a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofaran ring, a quinolizine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathine ring, a phenothiazine ring or a phenazine ring) With respect to those having hydrogen atoms among the above substituents Wa, the hydrogen atoms may be replaced with the above substituents. Examples of such hydrogen having substituents include a —$CONHSO_2$— group (sulfonylcarbamoyl or carbonylsulfamoyl), a —CONHCO— group (carbonylcarbamoyl) and a —$SO_2NHSO_2$— group (sulfonylsulfamoyl).

More specifically, examples of such hydrogen having substituents include an alkylcarbonylaminosulfonyl group (e.g., acerylaminosulfonyl), an arylcarbonylaminosulfonyl group (e.g., benzoylaminosulfonyl), an alkylsulfonylaminocarbonyl group (e.g., methylsalfonylaminocarbonyl) and an arylsulfonylaminocarbonyl group (e.g., p-methylphenylsulfonylaminocarbonyl)

Compound (Ac1) released in the present invention is illustrated.

Compound (Ac1) is a heterocyclic compound released by carrying out an oxidation coupling reaction with a color developing agent, and a compound increasing more sensitivity by adding the compound than a case of no addition. The heterocyclic compound related to the present invention is characterized in that it has the heterocyclic ring having 1 or 2 hetero atoms and may have a polycyclic heterocyclic ring structure in which carbon rings such as a benzene ring are ring-condensed with other heterocyclic ring. In this case, a hetero atom means an atom other than a carbon atom or a hydrogen atom. The heterocyclic ring means a ring compound containing at least one or more hetero atoms in the group of atoms constituting the ring. The hetero atom in the "heterocyclic ring having 1 or 2 hetero atoms" means atoms forming only the composition portion of a ring system of the heterocyclic ring and does not mean atoms which are positioned at an outside for the ring system, is separated from the ring system by at least one non-conjugated single bond and is the one portion of a further substituent of the ring system. Further, in case of the polycyclic heterocyclic ring, the hetero atom means atoms having 1 or 2 hetero atoms contained in the ring system which forms the polycyclic heterocyclic ring.

Although any heterocyclic compounds satisfying the above requirements can be employed, the heteroatom is preferably a nitrogen atom, a sulfur atom, an oxygen atom, a selenium atom, a tellurium atom, a phosphorus atom, a silicon atom or a boron atom. More preferably, the heteroatom is a nitrogen atom, a sulfur atom, an oxygen atom or a selenium atom. Further more preferably, the heteroatom is a nitrogen atom, a sulfur atom or an oxygen atom. Further much more preferably, the heteroatom is a nitrogen atom or a sulfur atom. Most preferably, the heteroatom is a nitrogen atom.

Although the number of members of heterocycles is not limited, a 3- to 8-membered ring is preferred. A 5- to 7-membered ring is more preferred. A 5- or 6-membered ring is further more preferred. A 5-membered ring is most preferred.

Although the heterocycles may be saturated or unsaturated, those having at least one unsaturated moiety are preferred. Those having at least two unsaturated moieties are more preferred. Stated in another way, although the heterocycle may be any of aromatic, pseudo-aromatic and non-aromatic heterocycles, aromatic and pseudo-aromatic heterocycles are preferred.

Examples of these heterocycles include a pyrrole ring, a thiophene ring, a furan ring and a pyridine ring; a ring resulting from pyridine ring condensation or carbon ring condensation thereof; an imidazole ring, a pyrazole ring, a thiazole ring, an isothiazole ring, an oxazole ring, an isooxazole ring, a pyrazine ring, a pyrimidine ring and a pyridazine ring; a ring resulting from carbon ring condensation thereof; and resulting from partial or complete saturation thereof, a pyrrolidine ring, a pyrroline ring and an imidazoline ring.

Representative examples of heterocycles will be shown below.

(a-1)

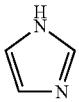

(a-2)

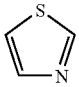

(a-3)

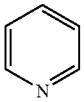

(a-4)

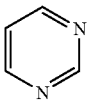

(a-5)

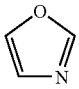

(a-6)

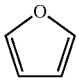

(a-7)

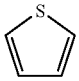

(a-8)

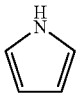

(a-9)

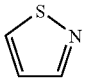

-continued (a-10)

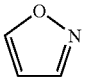

(a-11)

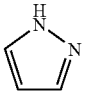

(a-12)

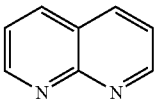

(a-13)

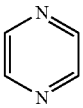

(a-14)

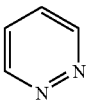

(a-15)

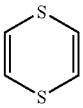

(a-16)

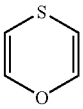

(a-17)

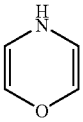

(a-18)

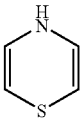

As the heterocycles resulting from benzene ring condensation, for example, the following can be shown.

(b-1)

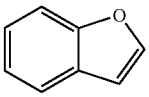

(b-2)

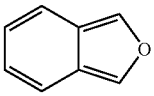

(b-3)

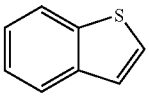

(b-4)

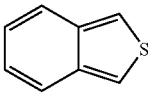

-continued
(b-5)
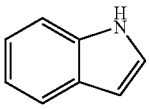
(b-6)
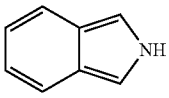
(b-7)
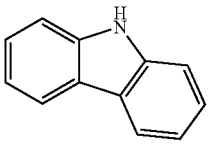
(b-8)
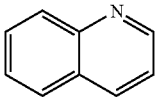
(b-9)
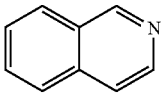
(b-10)
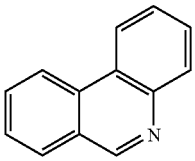
(b-11)
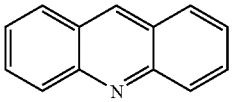
(b-12)
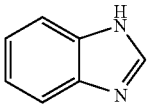
(b-13)
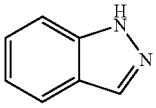
(b-14)
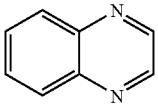
(b-15)
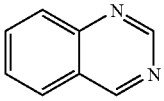
(b-16)
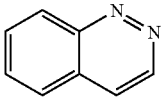
(b-17)
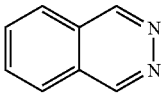
-continued
(b-18)
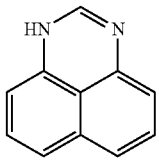
(b-19)
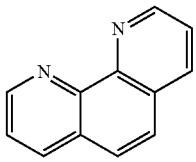
(b-20)
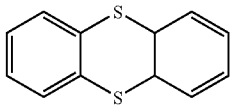
(b-21)
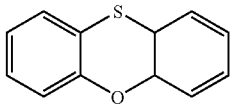
(b-22)
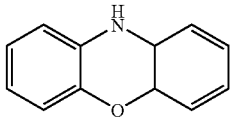
(b-23)
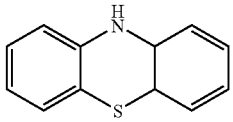
(b-24)
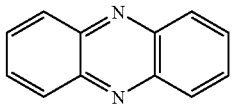
(b-25)
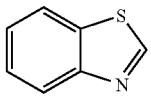
(b-26)
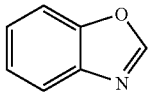
(b-27)
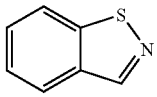
(b-28)
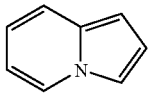
(b-29)
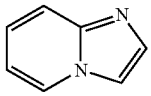
As the heterocycles resulting from partial or complete saturation, for example, the following can be shown.

(c-1)
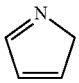
(c-2)
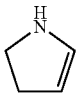
(c-3)
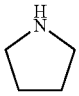
(c-4)
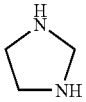
(c-5)
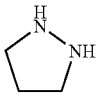
(c-6)
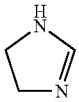
(c-7)
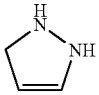
(c-8)
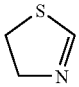
(c-9)
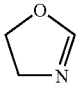
(c-10)
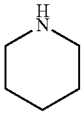
(c-11)
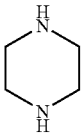
(c-12)
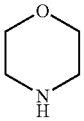
(c-13)
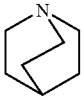
(c-14)
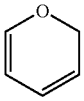
-continued
(c-15)
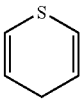
(c-16)
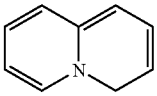
(c-17)
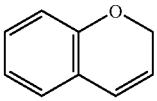
(c-18)
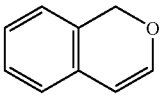
(c-19)
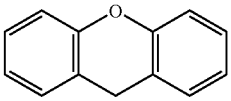
Furthermore, the following heterocycles can be used.
(d-1)
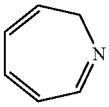
(d-2)
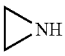
(d-3)
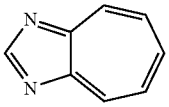
(d-4)
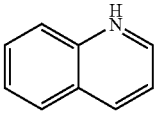
(d-5)
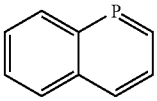
(d-6)
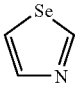
(d-7)
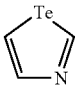
(d-8)
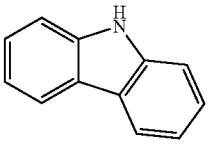
These heterocycles may nave any substituents or may be in the form of any condensed ring. As the substituents, there can be mentioned the aforementioned Wa. The tertiary nitrogen atom contained in heterocycles may be substituted into a quaternary nitrogen. Moreover, any other tautomeric structures which can be drawn with respect to heterocycles are chemically equivalent to each other.

However, it is preferable that a free thiol group (—SH) and a thiocarbonyl group (>C═S) are not substituted at the portion of the released compound increasing the sensitivity.

Among the above-mentioned heterocycles, (a-1) to (a-4) are preferable and in particular, (a-1) is preferable. In (a-2), (b-25) in which a benzene ring is ring-condensed is further preferable.

Then, compound (A) of the present invention is specifically illustrated.

Compound (A) of the present invention has a similar structure as a compound (coupler) which forms a dye by oxidation coupling with a color developing agent but it is new that compound (A) releases a compound increasing the sensitivity, namely, aforementioned compound (Ac1). The coupler structure may be a 4 equivalent coupler or a 2 equivalent coupler but in the present invention, the structure of a 2 equivalent coupler is preferable. The specific example of the coupler is specifically described in "Theory of Photographic Process" ($4^{th}$ Edition, edited by T. H. James, Macmillan, 1977) pages 291 to 334 and 354 to 361, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474, JP-A-60-66249 and the like for both of the 4 equivalent coupler and 2 equivalent coupler.

The example of compound (A) releasing compound (Ac1) by carrying out oxidation coupling reaction with a color developing agent which is preferably used in the present invention is mentioned below.

The structure preferably used in the present invention is a compound having a structure described in general formulae (1) to (12) below. These are compounds generally called as active methylene, pyrazolone, pyrazoloazole, phenol, naphthol and pyrrolotriazole, and they are known in the art.

(1)

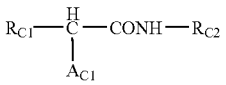

(2)

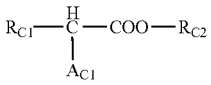

(3)

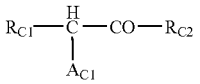

(4)

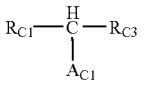

(5)

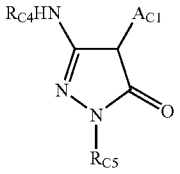

-continued (6)

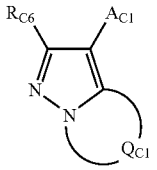

(7)

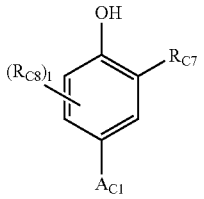

(8)

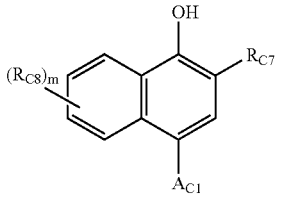

(9)

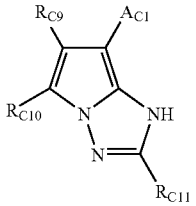

(10)

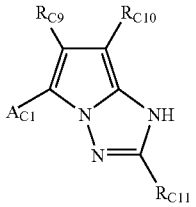

(11)

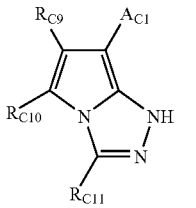

(12)

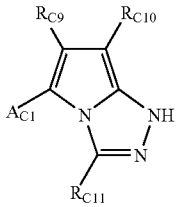

General formulae (1) to (4) are an active methylene coupler structure and $R_{c1}$ in the formulae is an acyl group, a cyano group, a nitro group, an aryl group, a hetero ring residual group, an alkoxycarbonyl group, an aryloxycarbonyl group, a carbamoyl group, a sulfamoyl group, an alkylsulfonyl group and an arylsulfonyl group.

In general formulae (1) to (3), $R_{c2}$ is an alkyl group, an aryl group or a hetero ring residual group which may optionally have a substituent. In the general formula (4), $R_{c3}$ is an aryl group and a hetero ring residual group which may optionally have a substituent. The substituent which $R_{c1}$, $R_{c2}$ and $R_{c3}$ may optionally have includes Wa.

In general formulae (1) to (4), $A_{c1}$ represents a structure in which a hydrogen atom is eliminated from compound ($A_{c1}$) released.

In general formulae (1) to (4), $R_{c1}$ and $R_{c2}$ may be mutually bound and $R_{c1}$ and $R_{c3}$ may be mutually bound to form a ring.

General formula (5) represents a compound called as a 5-pyrazoloazole base coupler structure and $R_{c4}$ in the general formula represents an alkyl group, an aryl group, an acyl group or a carbamoyl group. $R_{c5}$ represents a phenyl group or a phenyl group in which one or more of halogen atoms, alkyl groups, cyano groups, alkoxy groups, alkoxycarbonyl groups or acylamino groups are substituted.

Among the 5-pyrazoloazole base coupler represented by general formula (5), those in which $R_{c4}$ is an aryl group or an acyl group and a phenyl group in which $R_{c5}$ is substituted with one or more of halogen atoms are preferable.

These preferable groups are specifically described. $R_{c4}$ is an aryl group such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group or a 2-chloro-5-[2-(4-hydroxy-3-t-butylphenoxy)tetradecaneamido]phenyl group; or acetyl groups, an acyl group such as a 2-(2,4-di-t-pentylphenoxy) butanoyl group, a benzoyl group and a 3-(2,4-di-t-amylphenoxyacetoamodo)benzoyl group; and these groups may have may further optionally have a substituent. They are preferably an organic substituent linked with a carbon atom, an oxygen atom, a nitrogen atom, or a sulfur atom, or a halogen atom.

$R_{c5}$ is preferably substituted phenyl groups such as a 2,4,6-trichlorophenyl group, a 2,5-dichlorophenyl group and a 2-chlorophenyl group. $A_{c1}$ has the same meaning as those previously mentioned.

General formula (6) represents a compound called as a pyrazoloazole base coupler structure and $R_{c6}$ in the general formula represents a hydrogen atom or a substituent. $Q_{c1}$ represents a non metal atom group necessary for forming a 5-membered azole ring containing 2 to 4 nitrogen atoms and the azole ring may have a substituent (including a condensed ring).

Among the pyrazoloazole base coupler structure represented by general formula (6), imidazo[1,2-b]pyrazoles described in U.S. Pat. No. 4,500,630, pyrazolo[1,5-b]-1,2,4-triazoles described in U.S. Pat. No. 4,500,654 and pyrazolo[5,1-c]-1,2,4-triazoles described in U.S. Pat. No. 3,725,067 are preferable from the viewpoint of the spectral absorption characteristic of a coloring dye.

The detail of the substituent of the azole ring represented by the substituents $R_{c6}$ and $Q_{c1}$ is described in, for example, the 41$^{st}$ line of the second column to the 27$^{th}$ lines of the 8$^{th}$ column of the specification of U.S. Pat. No. 4,540,654. Preferably are a pyrazoloazole coupler structure described in JP-A-61-65245 in which a branched alkyl group is directly coupled with a pyrazoloazole group at 2,3 or 6-position, a pyrazoloazole coupler structure described in JP-A-61-65245 in which a sulfonamide group is contained in a molecule, a pyrazoloazole coupler structure described in JP-A-61-147254 which has an alkoxyphenylsulfonamidobalast group, a pyrazoloazole coupler structure described in JP-A-62-209457 or JP-A-63-307453 which has an alkoxy group and an aryloxy group at its 6-position, and a pyrazoloazole coupler structure described in JP-A-2-201443 which has a carbonamide group in its molecule. $A_{c1}$ has the same meaning as those previously mentioned.

General formulae (7) and (8) are a compound respectively called as a phenol base coupler structure and a naphthol base coupler structure and $R_{c7}$ in the formula represents a hydrogen atom or a group selected from —$CONR_{c12}R_{c13}$, —$SO_2NR_{c12}R_{c13}$, —$NHCOR_{c12}$, —$NHCONR_{c12}R_{c13}$ and —$NHSO_2NR_{c12}R_{c13}$. $R_{c12}$ and $R_{c13}$ represent a hydrogen atom or a substituent, In general formulae (7) and (8), $R_{c8}$ represents a substituent, 1 represents an integer selected from 0 to 2 and m represents an integer selected from 0 to 4. When 1 and m are 2 or more, $R_{c8}$'s being in plurality may be different respectively. The substituents of $R_{c8}$, $R_{c12}$ and $R_{c13}$ include Wa. $A_{c1}$ has the same meaning as those previously mentioned.

The example of the preferable compound having a phenol base coupler structure which is represented by general formula (7) includes 2-acyamino-5-alkylphenol base described in U.S. Pat. Nos. 2,369,929, 2,801,171, 2,772,162, 2,895,826, 3,772,002 and the like; 2,5-diacylaminophenol base described in U.S. Pat. Nos. 2,772,162, 3,758,308, 4,126,396, 4,334,011 and 4,327,173, German Patent Application 3329729, JP-A-59-166956 and the like; 2-phenylureido-5-acylaminophenol base described in U.S. Pat. Nos. 3,446,622, 4,333,999, 4,451,559, 4,427,767 and the like. $A_{c1}$ has the same meaning as those previously mentioned.

The example of the preferable compound having a phenol base coupler structure which is represented by general formula (8) includes 2-carbamoyl-1-naphthol base described in U.S. Pat. Nos. 2,474,293, 4,052,212, 4,146,396, 4,282,233, 4,296,200 and the like and 2-carbamoyl-5-amido-1-naphthol base described in U.S. Pat. No. 4,690,889 and the like. $A_{c1}$ has the same meaning as those previously mentioned.

General formulae (9) to (12) represent a coupler called as a pyrazoloazole and $R_{c9}$, $R_{c10}$ and $R_{c11}$ represent a hydrogen atom or a substituent. $A_{c1}$ has the same meaning as those previously mentioned. The substituents of $R_{c9}$, $R_{c10}$ and $R_{c11}$ include Wa. The example of the preferable compound having a pyrrolotriazole base coupler structure which is represented by general formulae (9) to (12) includes a coupler structure in which at least one of $R^{32}$ and $R^{33}$ is an electron attractive group which is described in European Patent Nos. 488248A1, 491197A1 and 545300. $A_{c1}$ has the same meaning as those previously mentioned.

Coupler structures having structures such as ring-condensed phenol, imidazole, pyrrole, 3-hydroxypyridine, active methylene, active methine, 5,5-ring-condensed heterocyclic ring and 5,6-ring-condensed heterocyclic ring can be additionally used.

As the ring-condensed phenol base coupler, coupler structures described in U.S. Pat. Nos. 4,327,173, 4,564,586, 4,904,575 and the like can be used.

As the imidazole base coupler, coupler structures described in U.S. Pat. Nos. 4,818,672, 5,051,347 and the like can be used.

As the 3-hydroxy pyridine base coupler, a coupler described in JP-A-1-315736 can be used.

As the active methylene and active methine base coupler structures, coupler structures described in U.S. Pat. Nos. 5,104,783, 5,162,196, and the like can be used.

As the 5,5-ring-condensed heterocyclic ring base coupler, a pyrrolopyrazole base coupler structure described in U.S.

Pat. No. 5,164,289, a pyrroloimidazole coupler structure described in JP-A-4-174429 and the like can be used.

As the 5,6-ring-condensed heterocyclic ring base coupler structure, a pyrazolopyrimidine base coupler structure described in U.S. Pat. No, 4,950,585, a pyrrolotriazine coupler structure described in JP-A-4-204730, a coupler structure described in European Patent No. 556700 and the like can be used.

In addition to the above-mentioned coupler structures, coupler structures described in German Patent Nos. 3819051A and 3823049, U.S. Pat. Nos. 4,840,883, 5,024,930, 5,051,347 and 4,481,268, European Patent Nos. 304856A2, 329036, 354549A2, 374781A2, 379110A2 and 386930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731, JP-A-4-204732 and the like can be used for the invention.

The specific example of compound (A) which can be used in the invention is shown below, but the invention cannot be limited by this, of course.

(C-1)

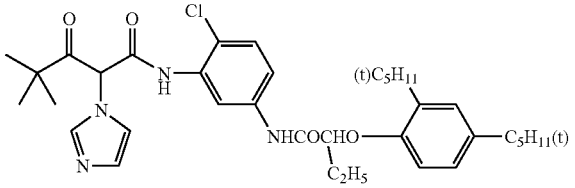

(C-2)

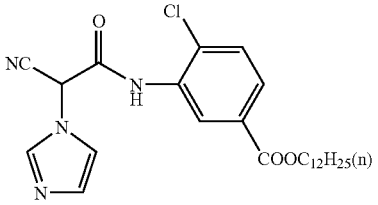

(C-3)

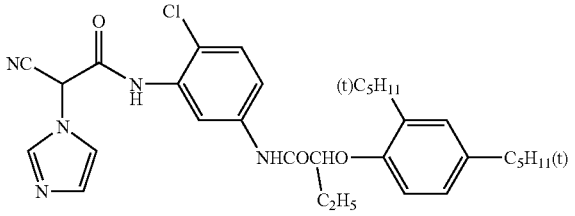

(C-4)

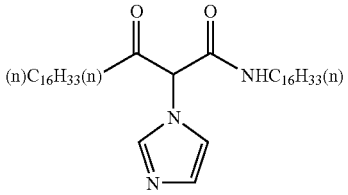

(C-5)

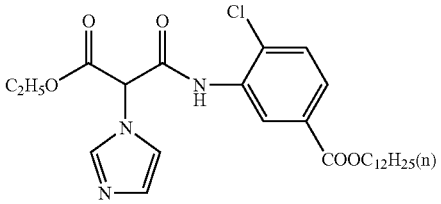

-continued (C-6)

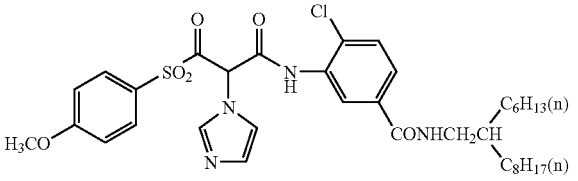

(C-7)

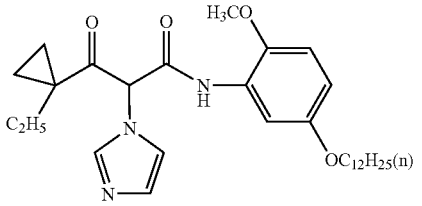

(C-8)

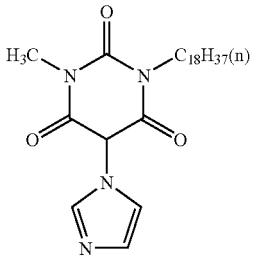

(C-9)

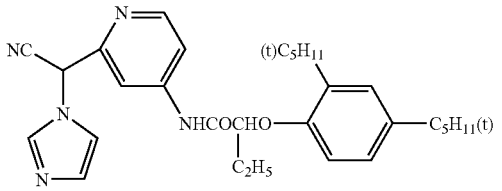

(C-10)

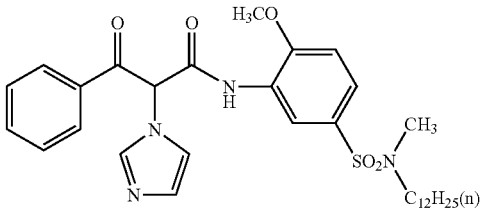

(C-11)

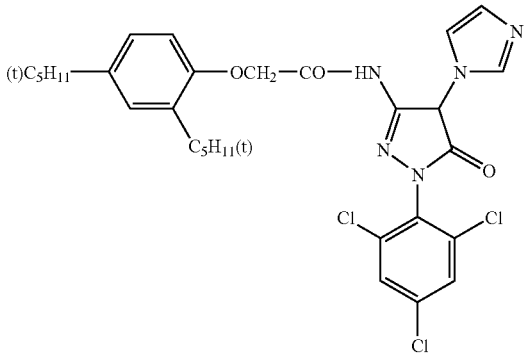

-continued (C-12)

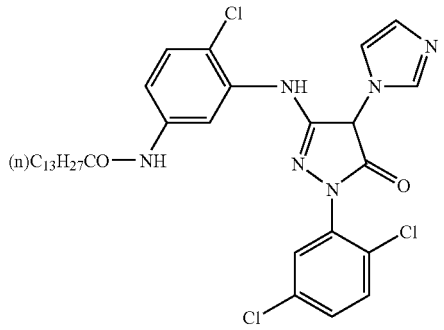

(C-13)

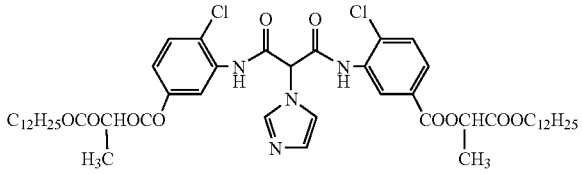

(C-14)

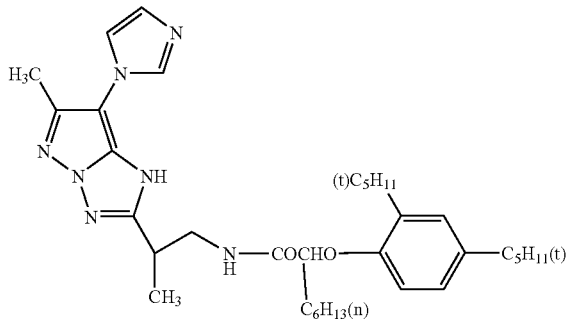

(C-15)

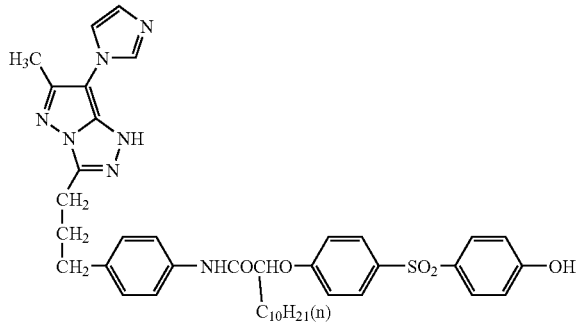

(C-16)

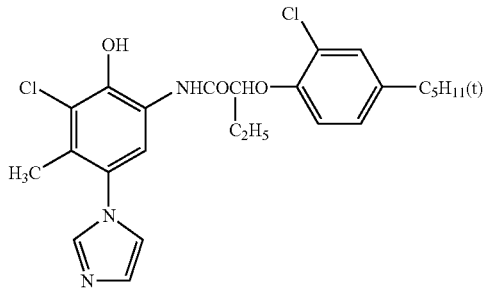

Compound (A) of the present invention can be used in combination with one or more arbitrary methods capable of exerting sensitivity enhancing effects or compounds capable of exerting sensitivity enhancing effects. The number and type of employed methods and contained compounds can be arbitrarily selected.

For example, compound (A) of the present invention may be used in combination with compounds each having at least three heteroatoms as described in JP-A's-2000-194085 and 2003-156823.

In the present invention, as long as compound (A) of the present invention can be applied to a silver halide photosensitive sensitive material (preferably a silver halide color photosensitive material), the addition site therefor, etc. are not particularly limited, and the compounds may be added to any of silver halide light-sensitive layer and nonsensitive layer.

In the use in a silver halide light-sensitive layer consisting of multiple layers of different speeds, although the addition may be effected to any of these layers, it is preferred that the compounds be incorporated in the layer of highest speed.

In the use in nonsensitive layer, the compounds are preferably incorporated in a nonsensitive layer disposed between a red-sensitive layer and a green-sensitive layer or between a green-sensitive layer and a blue-sensitive layer. The nonsensitive layer refers to any of all layers other than the silver halide emulsion layers which include an antihalation layer, an interlayer, a yellow filter layer and a protective layer.

The method of incorporating compound (A) of the present invention in a photosensitive material, although not particularly limited, can be selected from among, for example, the method of adding through emulsification dispersion of the compounds together with a high boiling organic solvent or the like, the method of adding through solid dispersion, the method of adding the compounds in solution form to a coating liquid (for example, dissolving the compounds in water, an organic solvent such as methanol or a mixed solvent before addition) and the method of adding during the preparation of silver halide emulsion. Among these, the method of incorporating in a photosensitive material through emulsification dispersion or solid dispersion is preferred. The method of incorporating in a photosensitive material through emulsification dispersion is more preferred.

As the emulsification dispersion method, use can be made of the in-water oil droplet dispersing method wherein the compounds are dissolved in a high-boiling organic solvent (optionally in combination with a low-boiling organic solvent), emulsified and dispersed in an aqueous solution of gelatin and added to a silver halide emulsion.

Examples of the high-boiling organic solvents for use in the inflater oil droplet dispersing method are listed in, for example, U.S. Pat. No. 2,322,027. Particulars of a latex dispersing method as one of polymer dispersing methods are described in, for example, U.S. Pat. No. 4,199,363, DE (OLS) U.S. Pat. No. 2,541,274, Jpn. Pat. Appln. KOKOKU Publication No. (hereinafter referred to as JP-B-)53-41091 and EP's 0,727,703 and 0,727,704. Further, a method of dispersion by an organic solvent soluble polymer is described in WO 88/00723.

Examples of the high-boiling organic solvents which can be employed in the above in-water oil droplet dispersing method include phthalic acid esters (e.g., dibutyl phthalate, dioctyl phthalate and di-2-ethylhexyl phthalate), esters of phosphoric acid or phosphonic acid (e.g., triphenyl phosphate, tricresyl phosphate and tri-2-ethylhexyl phosphate), fatty acid esters (e.g., di-2-ethylhexyl succinate and tributyl citrate), benzoic acid esters (e.g., 2-ethylhexyl benzoate and dodecyl benzoate), amides (e.g., N,N-diethyldodecanamide and N,N-dimethyloleamide, alcohols or phenols (e.g., isostearyl alcohol and 2,4-di-tert-amylphenol) anilines (e.g., N,N-dibutyl-2-butoxy-5-tert-octylaniline), chlorinated paraffins, hydrocarbons (e.g., dodecylbenzene and diisopropylnaphthalene) and carboxylic acids (e.g., 2-(2,4-di-tert-amylphenoxy)butyric acid). Further, as an auxiliary solvent, an organic solvent having a boiling point of 30 to 160° C. (e.g., ethyl acetate, butyl acetate, methyl ethyl ketone, cyclohexanone, methyl cellosolve acetate or dimethylformamide) may be used in combination therewith. The high-boiling organic solvents are preferably used in a mass ratio to compound (A) of the present invention of 0 to 10, more preferably 0 to 4.

The whole or portion of the auxiliary solvent can be removed from the emulsified dispersion by vacuum distillation, noodle washing, ultrafiltration or other appropriate means according to necessity from the viewpoint of enhancing of aging stability during storage in the state of emulsified dispersion and inhibiting of photographic property change and enhancing of aging stability with respect to a final coating composition after emulsion mixing.

The average particle size of thus obtained lipophilic fine particle dispersion is preferably in the range of 0.04 to 0.50 μm, more preferably 0.05 to 0.30 μm and most preferably 0.08 to 0.20 μm. The average particle size can be measured by the use of, for example, Coulter submicron particle analyzer model N4 (trade name, manufactured by Coulter Electronic).

As means for solid fine particle dispersion, there can be mentioned the method wherein powdery compound (A) of the present invention are dispersed in an appropriate solvent such as water with the use of a ball mill, a colloid mill, a vibration ball mill, a sand mill, a jet mill, a roller mill or ultrasonic so as to obtain a solid dispersion. During the dispersing, use can be made of a protective colloid (e.g., polyvinyl alcohol) or a surfactant (e.g., anionic surfactant such as sodium triisopropylbutanesulfonate (mixture of those whose three isopropyl substitution sites are different from each other)). In the above mills, beads such as those of zirconia are generally used as dispersing media. Thus, Zr, etc. leached from the beads may be mixed in the dispersion. The amount thereof is generally in the range of 1 to 1000 ppm although depending on dispersing conditions. When the content of Zr in photosensitive material is 0.5 mg or less per g of silver, there would occur practically no adverse effect. The water dispersion can be doped with an antiseptic (e.g., benzoisothiazolinone sodium salt).

In the present invention, in order to obtain a coagulation-free solid dispersion of high S/N and small grain size, use can be made of the dispersing method wherein a water dispersion liquid is converted to a high-velocity stream and thereafter a pressure drop is effected. The solid dispersing apparatus and technology employed for carrying out this dispersing method are described in detail in, for example, "Dispersion Rheology and Dispersing Technology" written by Toshio Kajiuchi and Hiroki Usui, pp. 357-403, Shinzansha Shuppan (1991) and "Progress of Chemical Engineering, 24th Series" edited by the corporate juridical person Society of Chemical Engineering, Tokai Chapter, pp. 184-185, Maki Shoten (1990).

The addition amount of compound (A) of the present invention is preferably in the range of 0.1 to 1500 mg/m$^2$, more preferably 1 to 1000 mg/m$^2$ and most preferably 5 to 500 mg/m$^2$. In the use in photosensitive silver halide emulsion layers, the addition amount is preferably in the range of $1\times10^{-5}$ to 1 mol, more preferably $1\times10^{-4}$ to $1\times10^{-1}$ mol and most preferably $1\times10^{-3}$ to $5\times10^{-2}$ mol per mol of silver contained in the same layer. Two or more compounds of the present invention may be used in combination. These compounds may be incorporated in the same layer or separate layers.

The pKa or compound (A) of the present invention is preferably in the range of 5 to 11, more preferably 6 to 10. The pKa values of compound (A) of the present invention are those determined in the following manner. 0.5 mL of 1 N sodium chloride is added to 100 mL of a solution dissolving 0.01 mmol of compound of the present invention in a 6:4 (mass ratio) mixture of tetrahydrofuran and water, and titrated with a 0.5 N aqueous potassium hydroxide solution under agitation in a nitrogen gas atmosphere. The pKa refers to the pH at the central position of inflexion point of titration curve having an axis of abscissas indicating the amount of aqueous potassium hydroxide solution dropped and an axis of ordinate indicating pH values. With respect to compounds having multiple dissociation sites, multiple inflexion points exist and multiple pKa values can be determined. Also, the inflexion point can be determined by monitoring ultraviolet/visible light absorption spectra and checking absorption changes.

As aforementioned, generally, the photographic speed depends on the size of silver halide emulsion grains. The larger the emulsion grains, the higher the photographic speed. However, the graininess is deteriorated in accordance with an increase of the size of silver halide grains. Therefore, the speed and the graininess fall in trade-off relationship.

The speed increase can be accomplished by the method of increasing coupler activity or the method of decreasing the amount of development inhibitor release coupler (DIR coupler) as well as the above increasing of the size of silver halide emulsion grains. However, when the speed increase is effected by these methods, graininess deterioration accompanies the same. These methods of changing of the size of emulsion grains, regulation of coupler activity and regulation of the amount of DIR coupler, in speed/graininess trade-off relationship, provide only "regulatory means" for deteriorating graininess while increasing speed, or improving graininess while lowering speed.

In the present invention, "enhancing the sensitivity" is not intended to provide a method of speed increase accompanied by graininess increase matching the speed increase.

According to the present invention, there is provided a method of sensitivity enhancement not accompanied by graininess increase, or a method of sensitivity enhancement wherein the sensitivity enhancement is conspicuous as compared with graininess increase. In the present invention, when sensitivity enhancement and graininess increase simultaneously occur, sensitivity enhancement is effected after graininess matching conducted by the above "regulatory means" to thereby find a substantial sensitivity enhancement.

The substantial sensitivity enhancement is defined as a sensitivity difference of 0.02 or greater exhibited when photosensitive materials are exposed through continuous wedge and speeds in terms of the logarithm of inverse number of exposure intensity realizing minimum density +0.5 are compared.

It is preferred that the photosensitive material of the present invention contains a compound selected from among the following compounds of type 1 and type 2.

Compounds of type 1 and type 2 contained in the silver halide photosensitive material of the present invention will be described in detail below.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables 2 and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2004-245929) among the compounds of inducing the reaction represented by the chemical reaction formula (1) (identical with the chemical reaction formula (1) described in JP-A-2004-245929). Preferred ranges of these compounds are the same as described in the cited, patent specifications.

General formula (1)

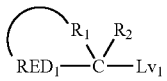

General formula (2)

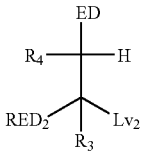

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group. ED represents an electron donating group.

General formula (3)

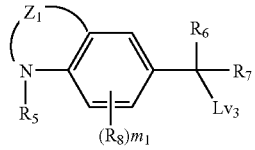

General formula (4)

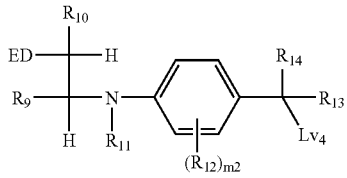

General formula (5)

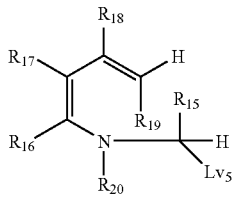

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring, $m_1$ is an integer of 0 to 3. $m_2$ is an integer of 0 to 4. Each of $L_{v3}$, $L_{v4}$ and $L_{v5}$ represents a split off group. ED represents an electron donating group.

General formula (6)

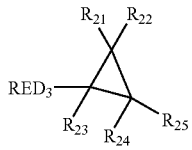

General formula (7)

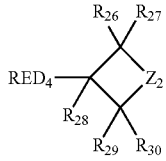

In the general formulae (6) and (7), each of $RED_3$ and $RED_4$ represents a reducing group. Each of $R_{21}$ to $R_{30}$ represents a hydrogen atom or a substituent. $Z_2$ represents $—CR_{111}R_{112}—$, $—NR_{113}—$ or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

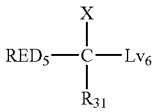

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

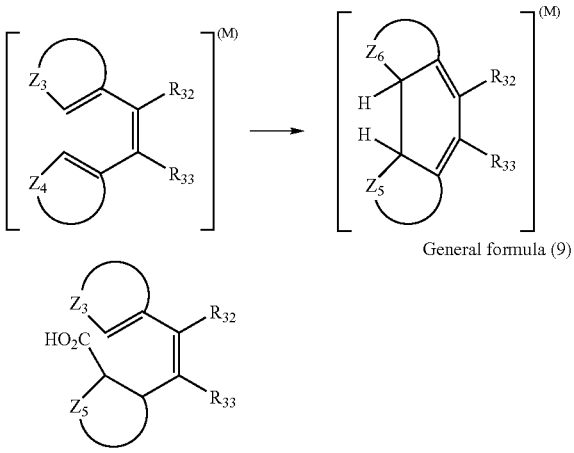

General formula (9)

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (9), $R_{32}$, $R_{33}$, $Z_3$ and $Z_5$ have the same meaning as in the chemical reaction formula (1).

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in JP-A-2004-245929). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

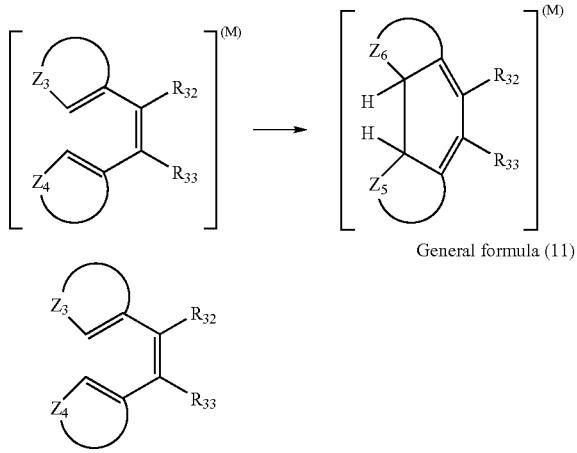

General formula (11)

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in tie molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{—}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

Specific examples of compounds of type 1 and type 2 will be shown below. Naturally, they in no way limit the scope of the present invention.

1

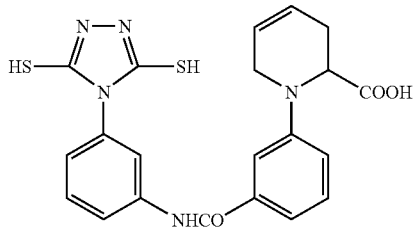

2

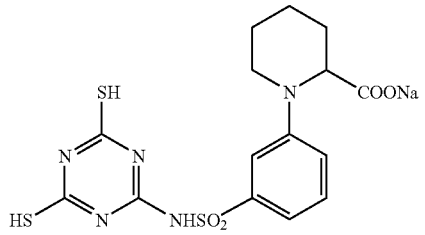

3

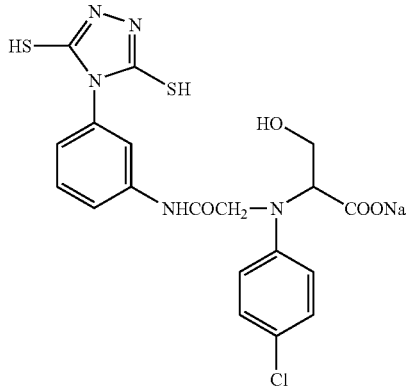

4

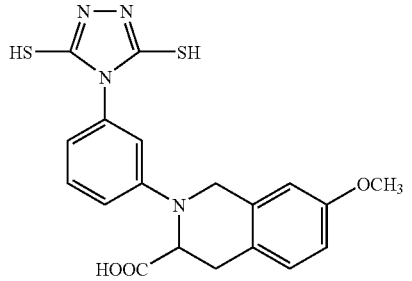

-continued
5
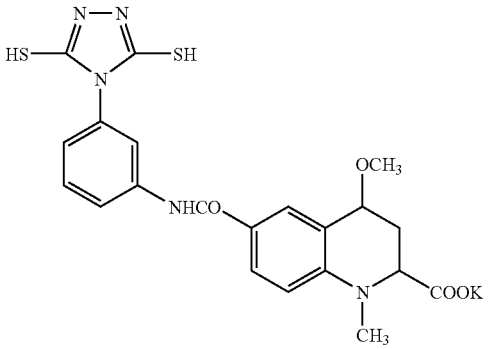
6
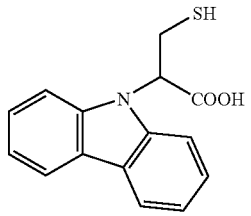
7
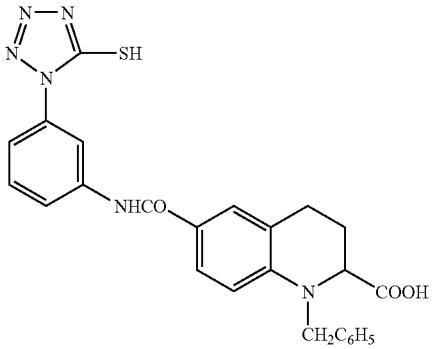
8
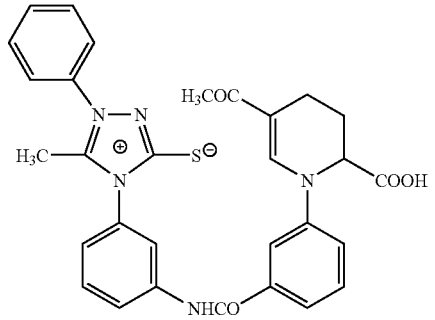
9
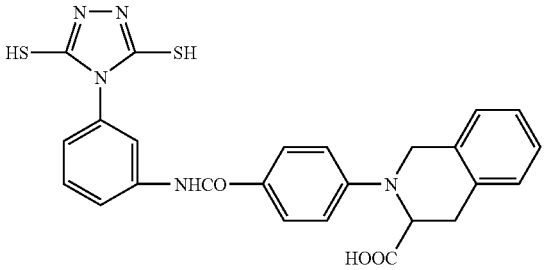
10
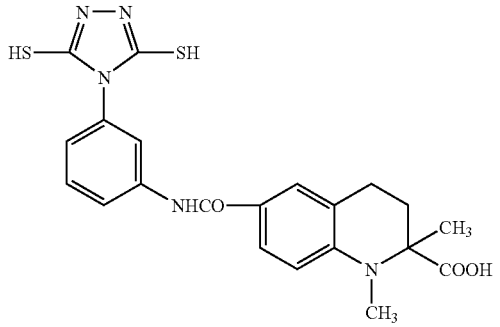
11
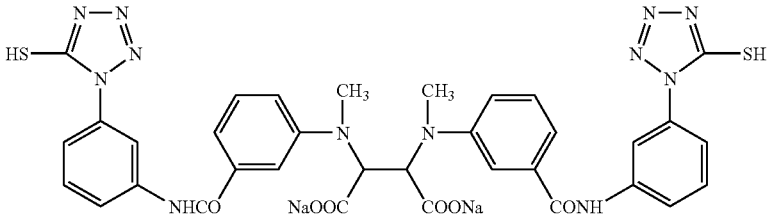
12
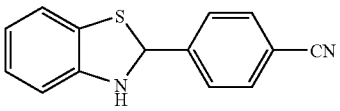
13
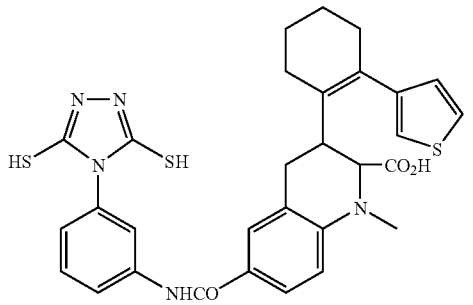

-continued
14
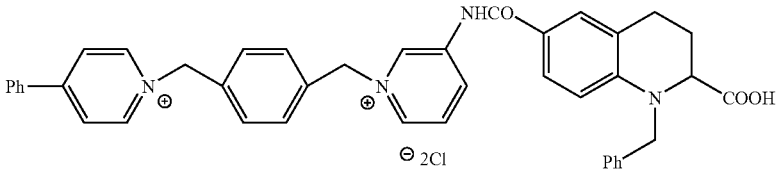
15
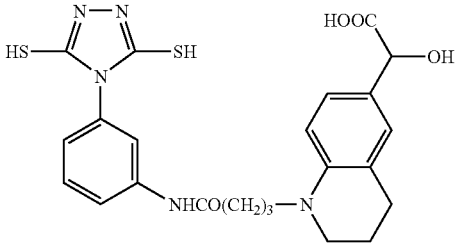
16
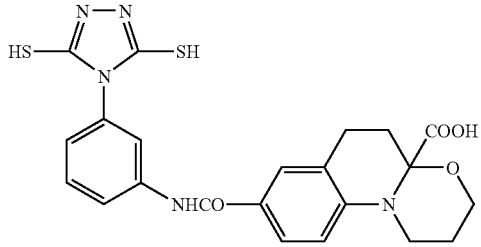
17
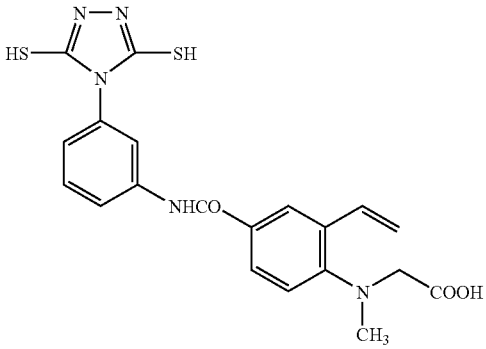
18
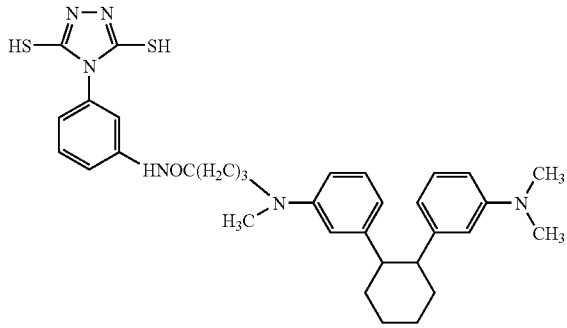
19
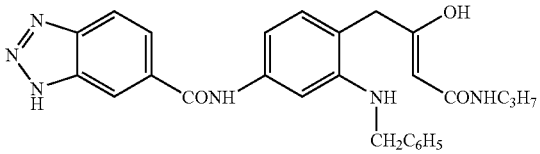
20
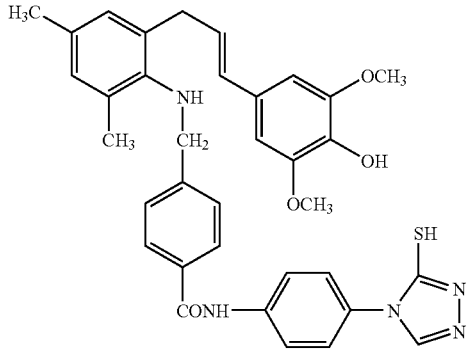
21
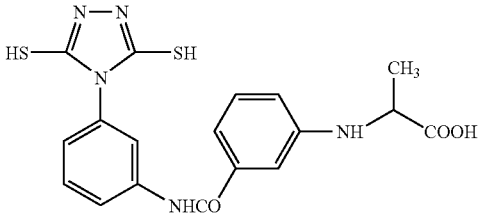
22
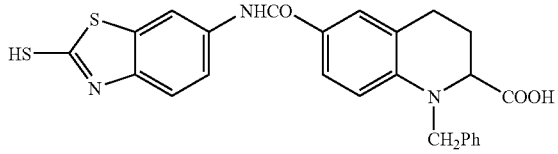

-continued
23
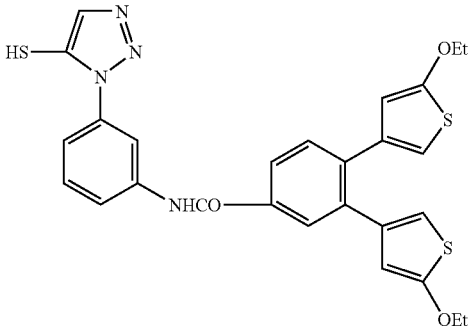
24
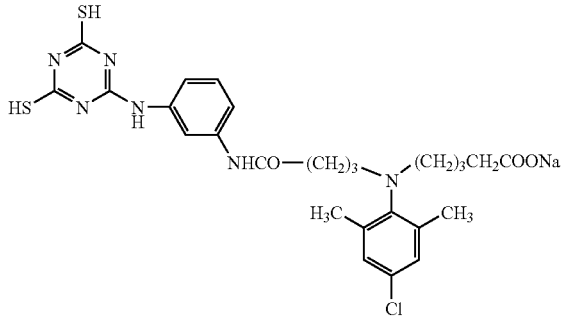
25
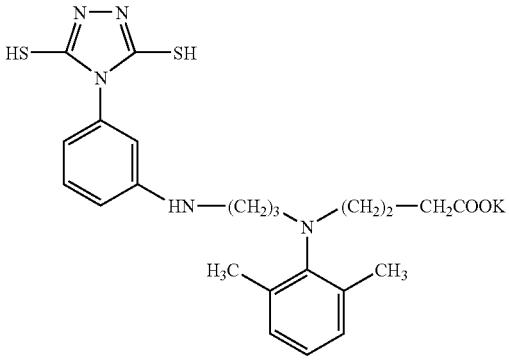
26
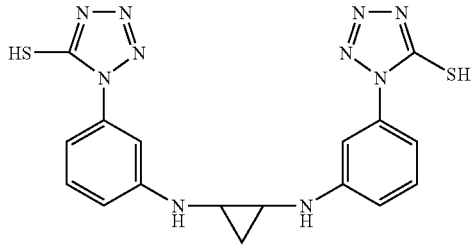
27
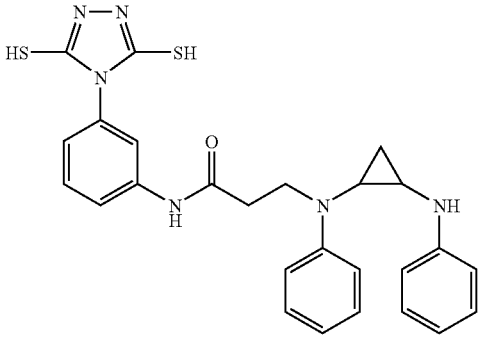
28
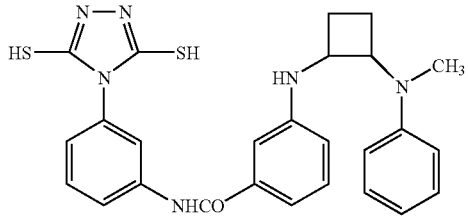
29
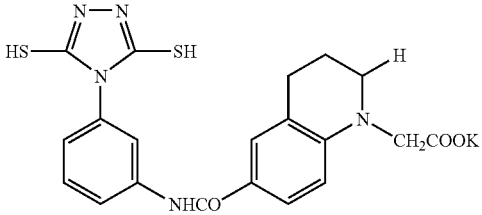
30
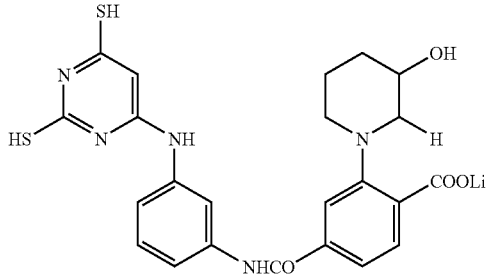

-continued
31
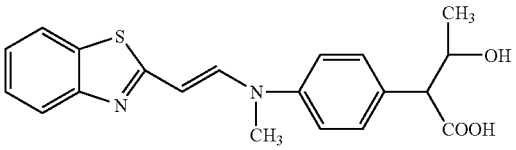
32
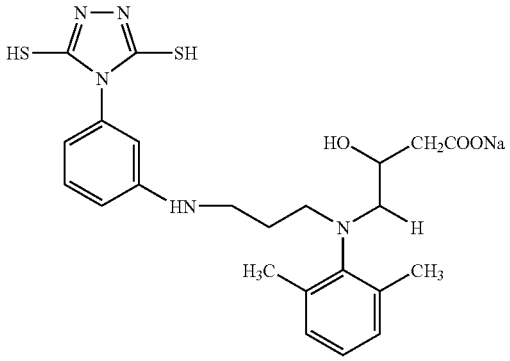
33
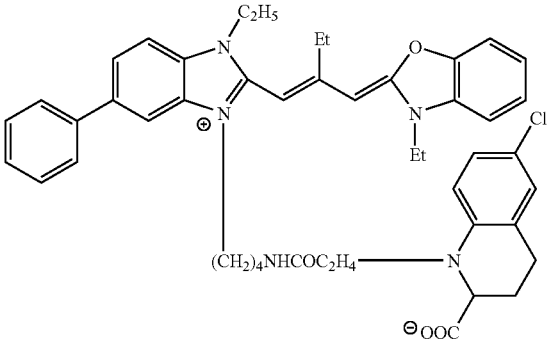
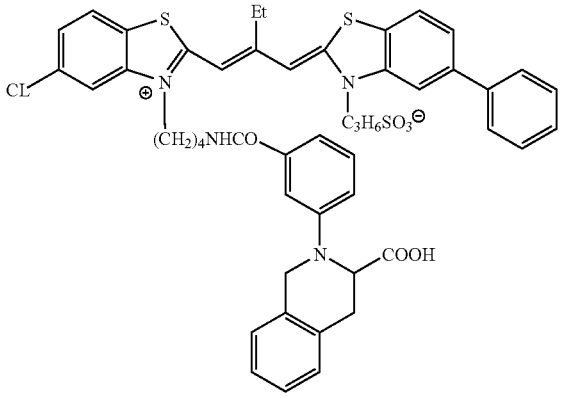
35
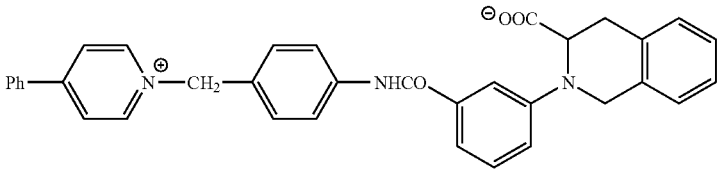
36
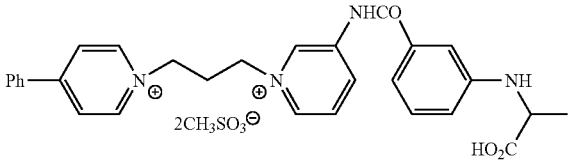
37
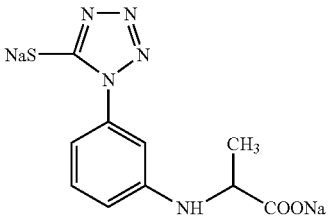
38
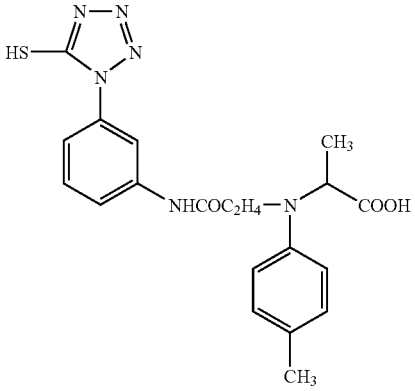
39
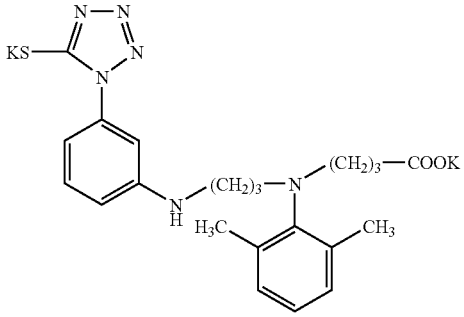

-continued
40
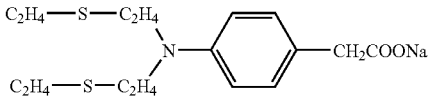
41
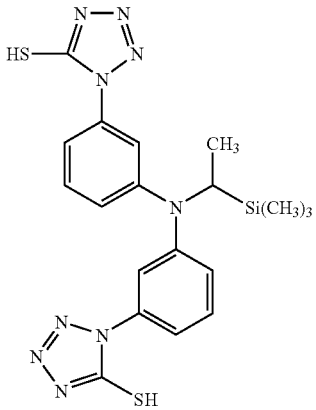
42
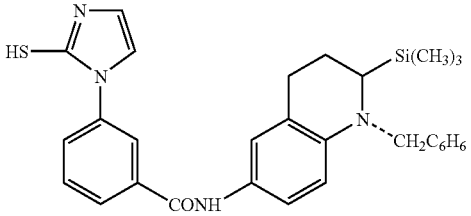
43
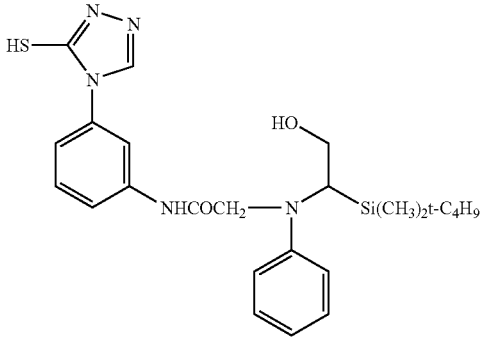
44
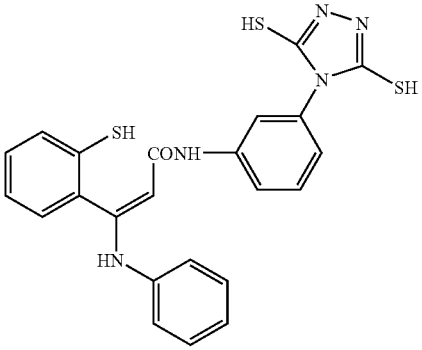
45
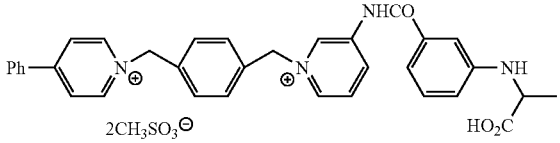
46
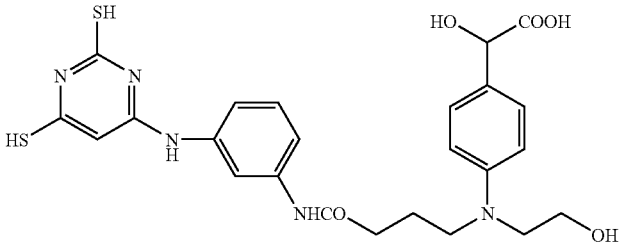
47
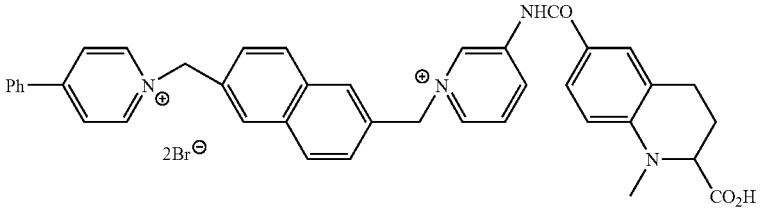

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

The present invention is preferably used in combination with the technique of increasing a light absorption with a spectral sensitizing dye. The multilayer adsorption can be effected by, for example, the method of effecting adsorption of sensitizing dyes on the surface of silver halide grains in an amount greater than monolayer saturated coating amount by the use of intermolecular force, or the method of effecting adsorption on silver halide grains of a dye consisting of two or more separate nonconjugated dye chromophores coupled with each other through covalent bond, known as coupled dye. The particulars thereof are described in the following patents.

JP-A's-10-239709, 11-133531, 2000-267216, 2000-275772, 2001-75222, 2001-75247, 2001-75221, 2001-75226, 2001-75223, 2001-255615, 2002-23294, 2002-99053, 2002-148767, 2002-287309, 2002-351004, 2002-365752, 2003-121956, 2004-184596, 2004-191926, 2004-219784, 2004-280062, 10-171058, 10-186559, 10-197980, 2000-81678, 2001-5132, 2001-13614, 2001-166413, 2002-49113, 2003-177486, 64-91134, 10-110107, 10-226758, 10-307358, 10-307359, 10-310715, 2000-231174, 2000-231172, 2000-231173, 2001-356442, 2002-55406, 2002-169258 and 2003-121957, and EP's 985965A, 985964A, 985966A, 985967A, 1085372A, 1085373A, 1172688A, 1199595A, 887700A1 and 1439417A1, and U.S. Pat. Nos. 6,699,652B1, 6,790,602B2, 6,794,121B2, 6,787,297B1, 2004/0142288A1 and 2004/0146818A1.

Moreover, the present invention is preferably used in combination with techniques described in JP-A's-10-239789, 10-171058, 2001-75222, 2002-287309, 2004-184596 and 2004-191926.

In the light-sensitive material to which the method of the present invention can be employed, at least one blue-sensitive layer, at least one green-sensitive layer, at least one red-sensitive layer and at least one non-light-sensitive layer need only be formed on a support. A typical example is a silver halide photosensitive material having, on a support, at least one blue, green and red sensitive layer each consisting of a plurality of silver halide emulsion layers sensitive to substantially the same color but different in sensitivity, and at least one non-light-sensitive layer. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (SH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/GL/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/medium-speed emulsion layer or low-speed emulsion layer/medium-speed emulsion layer/high-speed emulsion layer can be used. Furthermore, the arrangement can be changed as described above even when four or more layers are formed.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 μm or less or large grains having a projected area diameter of about 10 μm, and an emulsion can be either a polydisperse or monodisperse emulsion.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., US3,574,628, US3,655,394, and GB1,413,748, the disclosures of which are incorporated herein by reference, are also favorable.

Tabular grains having an aspect ratio of about 3 or more can also be used in the present invention. Tabular grains can be easily prepared by methods described in Gutoff, "Photographic Science and Engineering", Vol. 14, pp. 248 to 257 (1970); and US4,434,226, US4,414,310, US4,433,048, US4,439,520, and GB2,112,157, the disclosures of which are incorporated herein by reference.

It has been found that the sensitivity/graininess improving effect of compounds of the present invention can be enhanced when those are used in the same layer as that in which tabular grains having an average aspect ratio of 8 or more are used. In the present invention, the average aspect ratio of such tabular grains is preferably 8 or more and 100 or less, and more preferably 12 or more and 50 or less.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

It is preferable that the above emulsion has dislocation lines. In the tabular grains, it is especially preferred that dislocation lines are viewed in the fringe portion thereof. Dislocation lines can be introduced by, for example, adding an aqueous solution such as an alkali iodide aqueous solution to form a high silver iodide layer, adding AgI fine grains, or a method as described in JP-A-5-323487.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion mast be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 0.2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

The silver coating amount of a light-sensitive material of the present invention is preferably 8.0 g/m$^2$ or less.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surface active agents | pages 26–27 | page 650, right column | pages 875–876 |
| 9. Antistatic agents | page 27 | page 650, right column | pages 876–877 |
| 10. Matting agents | | | pages 878–879 |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and 11-24 (column 19)) represented by formulas (II) to (IV) in column 7, lines 36 to 58 of U.S. Pat. No. 4,476,219, the disclosures of which are incorporated herein by reference.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat. No. 4,366,237, GB2,125,570, EP96,873B, and DF3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of compounds (including a coupler) which react with a developing agent in an oxidized form to thereby release a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (1) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of oil-soluble organic compounds: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors; formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to M-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492;

antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

The present invention can be applied to various color photosensitive materials such as color negative films for general purposes or cinemas, color reversal films for slides and TV, color paper, color positive films and color reversal paper. Moreover, the present invention is suitable to lens equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

The specified photographic speed referred to in the present invention is determined by the method described in JP-A-63-236035. The determining method is substantially in accordance with JIS K 7614-1981 except that the development processing is completed within 30 min to 6 hr after exposure for sensitometry and that the development processing is performed according to Fuji Color standard processing recipe CN-16.

In the photosensitive material of the present invention, the thickness of photosensitive silver halide layer closest to the support through surface of the photosensitive material is preferably 24 μm or less, more preferably 22 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129, The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the light-sensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

The light-sensitive material according to the present invention can be developed by conventional methods described in the aforementioned RD. No. 17643, pages 28 and 29; RD. No. 18716, page 651, left to right columns; and RD No. 307105, pages 800 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges front 80 to 1300 mL per $m^2$ of the lightsensitive material, the employment of smaller amount is desirable from the viewpoint of reduction of environmental pollution load. Specifically, the amount of the replenisher more preferably ranges front 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

where C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid, Example 1 compounds listed on page 7 of JP-A-5-173312 and ferric complex salts.

For improving the biodegradability of bleaching agent, it is preferred that ferric complex salts of compounds listed in JP-A-4-251845, JP-A-4-268552, EP 588289, EP 591934 and JP-A-6-208213 be used as the bleaching agent. The concentration of these bleaching agents preferably ranges from 0-05 to 0.3 mol per liter of solution having bleaching capability, and it is especially preferred that a design be made at 0.1 to 0.15 mol per liter for the purpose of reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally at a concentration calculated by the following formula. This enables keeping the concentration in the mother liquor constant.

$$C_R=C_T\times(V_1+V_2)/V_1+C_P$$

$C_R$: concentration of each component in the replenisher, $C_T$: concentration of the component in the mother liquor (processing tank solution), $C_P$: component concentration consumed during processing, $V_1$: amount of replenisher having bleaching capability supplied per $m^2$ of photosensitive material (mL), and $V_2$: amount carried from previous bath by 1 $m^2$ of photosensitive material (mL).

In addition, a pH buffer is preferably incorporated in the bleaching solution, and it is especially preferred to incorporate a dicarboxylic acid of low order such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and most preferably 100 to 300 mL of a bleaching replenisher per $m^2$ of photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulae (I) and (II) of JP-A-6-301169 either individually or in combination in the processing solution having fixing capability. Further, the use of not only p-toluenesulfinic salts but also sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilvering, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and more preferably 200 to 600 mL per $m^2$ of the photosensitive material.

Silver is preferably recovered by installing any of various silver recovering devices in an in-line or off-line mode in the bleach-fix or fixation step. In-line installation enables processing with the silver concentration of solution lowered, so that the amount of replenisher can be reduced. It is also suitable to conduct an off-line silver recovery and recycle residual solution for use as a replenisher.

The bleach-fix and fixation steps can each be accomplished by the use of multiple processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to the washing and stabilization steps. In particular, with respect to the stabilizing solution, the use of azolylmethylamines described in EP 504609 and EP 519190 and N-methylolazoles described in JP-A-4-362943 in place of formaldehyde and the conversion of magenta coupler to two-equivalent form so as to obtain a surfactant solution not containing any image stabilizer such as formaldehyde are preferred from the viewpoint of protecting working environment.

Further, stabilizing solutions described in JP-A-6-289559 can preferably be used for reducing the adhesion of refuse to a magnetic recording layer applied to the photosensitive material.

The replenishing amount of washing and stabilizing solutions is preferably in the range of 80 to 1000 mL, more preferably 100 to 500 mL, and most preferably 150 to 300 mL, per $m^2$ of the photosensitive material from the viewpoint that washing and stabilizing functions are ensured and that the amount of waste solution is reduced to contribute to environment protection. In the processing conducted with the above replenishing amount, known mildewproofing agents such as thiabendazole, 1,2-benzoisothiazolin-3-one and 5-chloro-2-methylisothiazolin-3-one, antibiotics such as gentamicin, and water deionized by the use of, for example, an ion exchange resin are preferably used for preventing the breeding of bacteria and mildew. The joint use of deionized water, a mildewproofing agent and an antibiotic is more effective than single use thereof.

With respect to the solution placed in the washing or stabilizing solution tank, it is also preferred that the replenishing amount be reduced by conducting a reverse osmosis membrane treatment as described in JP-A's-3-46652, 3-53246, 3-55542, 3-121448 and 3-126030. A low-pressure reverse osmosis membrane is preferably used as the reverse osmosis membrane of the above treatment.

In the processing of the present invention, it is especially preferred that an evaporation correction of processing solution be carried out as disclosed in JIII (Japan Institute of Invention and Innovation) Journal of Technical Disclosure No. 94-4992. In particular, the method in which a correction is effected with the use of information on the temperature and humidity of developing machine installation environment in accordance with Formula 1 on page 2 thereof is preferred. Water for use in the evaporation correction is preferably procured from the washing replenishing tank. In that instance, deionized water is preferably used as the washing replenishing water.

Processing agents set forth on page 3, right column, line 15 to page 4, left column, line 32 of the above journal of technical disclosure are preferably used in the present invention. Film processor described on page 3, right column, lines 22 to 28 thereof is preferably used as the developing machine in the processing of the present invention.

Specific examples of processing agents, automatic developing machines and evaporation correction schemes preferably employed in carrying out of the present invention are described on page 5, right column, line 11 to page 7, right column, last line of the above journal of technical disclosure.

The processing agent for use in the present invention may be supplied in any form, for example, form of a liquid agent with the same concentration as in use or concentrated one, granules, powder, tablets, a paste or an emulsion. For example, a liquid agent stored in a container of low oxygen permeability is disclosed in JP-A-63-17453, vacuum packed powder or granules in JP-A's-4-19655 and 4-230748, granules containing a water soluble polymer in JP-A-4-221951, tablets in JP-A's-51-61837 and 6-102628 and a paste processing agent in PCT National Publication 57-500485. Although any of these can be suitably used, from the viewpoint of easiness in use, it is preferred to employ a liquid prepared in the same concentration as in use in advance.

Any one or a composite of polyethylene, polypropylene, polyvinyl chloride, polyethylene terephthalate, nylon, etc. is molded into the container for storing the above processing agents. These materials are selected in accordance with the required level of oxygen permeability. A material of low oxygen permeability is preferably used for storing an easily oxidized liquid such as a color developing solution, which is, for example, polyethylene terephthalate or a composite material of polyethylene and nylon. It is preferred that each of these materials be used in the container at a thickness of 500 to 1500 μm so that the oxygen permeability therethrough is 20 $mL/m^2 \cdot 24\ hr \cdot atm$ or less.

The processing solution for color reversal film to be employed in the present invention will be described below.

With respect to the processing of color reversal film, detailed descriptions are made in Public Technology No. 6 (Apr. 1, 1991) issued by Aztek, page 1, line 5 to page 10, line 5 and page 15, line 8 to page 24, line 2, any of which can be preferably applied thereto.

In the processing of color reversal film, an image stabilizer is added to a conditioning bath or a final bath. Examples of suitable image stabilizers include formalin, formaldehyde sodium bisulfite and N-methylolazoles. Formaldehyde sodium bisulfite and N-methylolazoles are preferred from the viewpoint of working environment. Among the N-methylolazoles, N-methyloltriazole is especially preferred. The contents of descriptions on color developing solution, bleaching solution, fixing solution, washing water, etc. made in connection with the processing of color negative films are also preferably applicable to the processing of color reversal films.

Processing agent E-6 available from Eastman Kodak and processing agent CR-56 available from Fuji Photo Film Co., Ltd. can be mentioned as preferred color reversal film processing agents including the above feature.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellalosetriacetate, celluloseacetatepropionate, celluloseacetatebutylate, and cellulosetripropionate, acrylic resin, and polyvinylacetal resin, Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 μm, preferably 0.2 to 5 μm, and more preferably, 0.3 to 3 μm. The weight ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341136, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in US5,336,589, US5,250,404, US5,229,259, US5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94-6023 (JIII; Mar. 15, 1994), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred.

Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin, Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/$m^2$, and particularly preferably, 10 to 350 mg/$m^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25 mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of S the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z). A color photosensitive film of the present invention is also suited as a film with lens such as the Fuji Film FUJICOLOR UTSURUNDESU SUPER SLIM.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and F and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP300AR, PP3008A, PP1828AR, PP1828A, PP125BAR, PP1258A, 2F728AR, and PP728A, and a recommended processing chemicals are the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35 mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy® disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy® disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

Each of layers having compositions as the under-description was coated in piles on a cellulose triacetate film support on which under-coating was carried out, to prepare a multilayer color photosensitive material (sample 101).

Coating of Light-sensitive Layer

Each of layers having compositions as the under-description was coated in piles to prepare a color negative film sample 101.

(Compositions of Light-sensitive Layers)

The number corresponding to each component indicates the coating amount in units of g/m$^2$. The coating amount of a silver halide is indicated by the amount of silver.

| (Sample 101) | | |
|---|---|---|
| 1st layer (1st antihalation layer) | | |
| Black colloidal silver | silver | 0.108 |
| Silver iodobromide emulsion grain (average grain diameter 0.07 μm, silver iodide content 2 mol %) | silver | 0.011 |
| Gelatin | | 0.900 |
| ExM-1 | | 0.040 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| 2nd layer (2nd antihalation layer) | | |
| Black colloidal silver | silver | 0.058 |
| Gelatin | | 0.440 |
| ExY-1 | | 0.040 |
| ExF-1 | | 0.005 |
| F-8 | | 0.001 |
| Solid disperse dye ExF-7 | | 0.130 |
| HBS-1 | | 0.080 |
| 3rd layer (Interlayer) | | |
| ExC-2 | | 0.045 |
| Cpd-1 | | 0.092 |
| Cpd-8 | | 0.015 |
| Polyethylaclyrate latex | | 0.220 |
| HBS-1 | | 0.120 |
| Gelatin | | 0.740 |
| 4th layer (Low-speed red-sensitive emulsion layer) | | |
| Em-C | silver | 0.540 |
| Em-D | silver | 0.360 |
| Em-E | silver | 0.220 |
| ExC-1 | | 0.188 |
| ExC-2 | | 0.012 |
| ExC-3 | | 0.077 |
| ExC-4 | | 0.123 |
| ExC-5 | | 0.012 |
| ExC-6 | | 0.008 |
| ExC-8 | | 0.053 |
| ExC-9 | | 0.020 |
| ExY-3 | | 0.009 |
| Cpd-2 | | 0.025 |
| Cpd-4 | | 0.023 |
| Cpd-7 | | 0.015 |

-continued (Sample 101)

| | | |
|---|---|---|
| UV-2 | | 0.050 |
| UV-3 | | 0.080 |
| UV-4 | | 0.020 |
| HBS-1 | | 0.250 |
| HBS-5 | | 0.038 |
| Gelatin | | 2.100 |
| 5th layer (Medium-speed red-sensitive emulsion layer) | | |
| Em-B | silver | 0.340 |
| Em-C | silver | 0.320 |
| ExC-1 | | 0.140 |
| ExC-2 | | 0.080 |
| ExC-3 | | 0.028 |
| ExC-4 | | 0.110 |
| ExC-5 | | 0.018 |
| ExC-6 | | 0.012 |
| ExC-8 | | 0.019 |
| ExC-9 | | 0.004 |
| ExY-3 | | 0.007 |
| Cpd-2 | | 0.036 |
| Cpd-4 | | 0.028 |
| Cpd-7 | | 0.020 |
| HBS-1 | | 0.120 |
| Gelatin | | 1.290 |
| 6th layer (High-speed red-sensitive emulsion layer) | | |
| Em-A | silver | 1.310 |
| ExC-1 | | 0.240 |
| ExC-3 | | 0.030 |
| ExC-6 | | 0.022 |
| ExC-8 | | 0.110 |
| ExC-9 | | 0.024 |
| ExM-6 | | 0.060 |
| ExY-3 | | 0.014 |
| Cpd-2 | | 0.060 |
| Cpd-4 | | 0.079 |
| Cpd-7 | | 0.030 |
| Cpd-9 | | 0.080 |
| HBS-1 | | 0.290 |
| HBS-2 | | 0.060 |
| Gelatin | | 1.920 |
| 7th layer (Interlayer) | | |
| Cpd-1 | | 0.090 |
| Cpd-6 | | 0.372 |
| Cpd-8 | | 0.032 |
| Solid disperse dye ExF-4 | | 0.032 |
| HBS-1 | | 0.052 |
| Polyethylacrylate latex | | 0.090 |
| Gelatin | | 0.900 |
| 8th layer (layer for donating interlayer effect to red-sensitive layer) | | |
| Em-F | silver | 0.260 |
| Em-G | silver | 0.130 |
| Cpd-4 | | 0.030 |
| ExM-2 | | 0.140 |
| ExM-3 | | 0.016 |
| ExM-4 | | 0.010 |
| ExY-1 | | 0.017 |
| ExY-3 | | 0.005 |
| ExY-4 | | 0.041 |
| ExC-7 | | 0.010 |
| ExC-10 | | 0.007 |
| HBS-1 | | 0.222 |
| HBS-3 | | 0.003 |
| HBS-5 | | 0.030 |
| Gelatin | | 0.850 |
| 9th layer (Low-speed green-sensitive emulsion layer) | | |
| Em-J | silver | 0.470 |
| Em-K | silver | 0.300 |
| Em-L | silver | 0.140 |
| ExM-2 | | 0.245 |
| ExM-3 | | 0.050 |

-continued (Sample 101)

| | | |
|---|---|---|
| ExM-4 | | 0.120 |
| ExY-1 | | 0.010 |
| ExY-3 | | 0.006 |
| ExC-7 | | 0.004 |
| ExC-10 | | 0.002 |
| HBS-1 | | 0.330 |
| HBS-3 | | 0.008 |
| HBS-4 | | 0.200 |
| HBS-5 | | 0.050 |
| Cpd-5 | | 0.020 |
| Cpd-7 | | 0.020 |
| Gelatin | | 1.840 |
| 10th layer (Medium-speed green-sensitive emulsion layer) | | |
| Em-I | silver | 0.360 |
| Em-J | silver | 0.160 |
| ExM-2 | | 0.057 |
| ExM-3 | | 0.022 |
| ExM-4 | | 0.005 |
| ExM-5 | | 0.005 |
| ExY-3 | | 0.004 |
| ExC-6 | | 0.006 |
| ExC-7 | | 0.014 |
| ExC-8 | | 0.050 |
| ExC-10 | | 0.010 |
| HBS-1 | | 0.020 |
| HBS-3 | | 0.060 |
| HBS-4 | | 0.002 |
| HBS-5 | | 0.020 |
| Cpd-5 | | 0.020 |
| Cpd-7 | | 0.010 |
| Gelatin | | 0.650 |
| 11th layer (High-speed green-sensitive emulsion layer) | | |
| Em-H | silver | 1.150 |
| ExC-6 | | 0.003 |
| ExC-8 | | 0.014 |
| ExM-1 | | 0.017 |
| ExM-2 | | 0.025 |
| ExM-3 | | 0.020 |
| ExM-4 | | 0.005 |
| ExM-5 | | 0.005 |
| ExM-6 | | 0.060 |
| ExY-3 | | 0.008 |
| ExY-4 | | 0.005 |
| Cpd-3 | | 0.005 |
| Cpd-4 | | 0.007 |
| Cpd-5 | | 0.020 |
| Cpd-7 | | 0.020 |
| Cpd-9 | | 0.080 |
| HBS-1 | | 0.149 |
| HBS-3 | | 0.003 |
| HBS-4 | | 0.020 |
| HBS-5 | | 0.037 |
| Polyethylacrylate latex | | 0.090 |
| Gelatin | | 1.200 |
| 12th layer (Yellow filter layer) | | |
| Cpd-1 | | 0.090 |
| Cpd-8 | | 0.032 |
| Solid disperse dye ExF-2 | | 0.074 |
| Solid disperse dye ExF-5 | | 0.008 |
| Oil-soluble dye ExF-6 | | 0.008 |
| HBS-1 | | 0.040 |
| Gelatin | | 0.615 |
| 13th layer (Low-speed blue-sensitive emulsion layer) | | |
| Em-O | silver | 0.360 |
| Em-P | silver | 0.110 |
| Em-Q | silver | 0.009 |
| ExC-1 | | 0.022 |
| ExC-7 | | 0.006 |

-continued (Sample 101)

| | | |
|---|---|---|
| ExC-10 | | 0.003 |
| ExY-1 | | 0.003 |
| ExY-2 | | 0.350 |
| ExY-3 | | 0.007 |
| ExY-4 | | 0.050 |
| ExY-5 | | 0.410 |
| Cpd-2 | | 0.100 |
| Cpd-3 | | 0.004 |
| HBS-1 | | 0.220 |
| HBS-5 | | 0.070 |
| Gelatin | | 1.750 |
| 14th layer (Medium-speed blue-sensitive emulsion layer) | | |
| Em-N | silver | 0.620 |
| ExY-2 | | 0.041 |
| ExY-3 | | 0.006 |
| ExY-4 | | 0.040 |
| ExY-5 | | 0.050 |
| Cpd-2 | | 0.035 |
| Cpd-3 | | 0.001 |
| Cpd-7 | | 0.016 |
| HBS-1 | | 0.060 |
| Gelatin | | 0.350 |
| 15th layer (High-speed blue-sensitive emulsion layer) | | |
| Em-M | silver | 0.430 |
| ExY-2 | | 0.041 |
| ExY-3 | | 0.002 |
| ExY-4 | | 0.030 |
| ExY-5 | | 0.050 |
| Cpd-2 | | 0.035 |
| Cpd-3 | | 0.001 |
| Cpd-7 | | 0.016 |
| Cpd-9 | | 0.080 |
| HBS-1 | | 0.060 |
| Gelatin | | 0.540 |
| 16th layer (1st protective layer) | | |
| Silver iodobromide emulsion grain (average grain diameter 0.07 μm, silver iodide content 2 mol %) | silver | 0.323 |
| UV-1 | | 0.210 |
| UV-2 | | 0.127 |
| UV-3 | | 0.190 |
| UV-4 | | 0.020 |
| UV-5 | | 0.204 |
| ExF-8 | | 0.001 |
| ExF-9 | | 0.001 |
| ExF-10 | | 0.002 |
| ExF-11 | | 0.001 |
| F-11 | | 0.005 |
| S-1 | | 0.086 |
| HBS-1 | | 0.170 |
| HBS-4 | | 0.052 |
| Gelatin | | 2.150 |

-continued (Sample 101)

| | |
|---|---|
| 17th layer (2nd protective layer) | |
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.700 |

In addition to the above components, to improve the storage stability, processability, resistance to pressure, antiseptic and mildewproofing properties, antistatic properties, and coating properties, the individual layers contained W-1 to W-13, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 1.210 kg |
| W-11 | 0.400 kg |
| F-15 | 0.006 kg |
| Water | 8.384 kg |
| Total | 10.000 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill, thereby obtaining a solid disperse dye ExF-2. The average grain size of the fine dye grains was 0.15 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

The characteristics of emulsion used in examples of the present invention will be described in Tables 1 to 4.

TABLE 1

Characteristics of silver halide grains contained in Em-A to Em-Q

| Emulsion name | Layer used | Grain shape | ESD*1 (μm) | ECD (μm)*2/ VC (%)*3 |
|---|---|---|---|---|
| Em-A | High-speed red-sensitive layer | (111) main plane tabular grain | 1.30 | 3.50/32 |
| Em-B | Medium-speed red-sensitive layer | (111) main plane tabular grain | 0.95 | 2.20/32 |
| Em-C | Medium and low-speed red-sensitive layers | (111) main plane tabular grain | 0.69 | 1.30/35 |
| Em-D | Low-speed red-sensitive layer | (111) main plane tabular grain | 0.48 | 0.89/17 |
| Em-E | Low-speed red-sensitive layer | (111) main plane tabular grain | 0.31 | 0.40/20 |
| Em-F | Layer for donating interlayer effect to red-sensitive layer | (111) main plane tabular grain | 0.78 | 1.38/24 |
| Em-G | Layer for donating interlayer effect to red-sensitive layer | (111) main plane tabular grain | 0.95 | 2.20/32 |
| Em-H | High-speed green-sensitive layer | (111) main plane tabular grain | 1.30 | 3.50/32 |

TABLE 1-continued

| Characteristics of silver halide grains contained in Em-A to Em-Q | | | | |
|---|---|---|---|---|
| Em-I | Medium-speed green-sensitive layer | (111) main plane tabular grain | 0.95 | 2.20/32 |
| Em-J | Medium and low-speed green-sensitive layers | (111) main plane tabular grain | 0.74 | 1.64/34 |
| Em-K | Low-speed green-sensitive layer | (111) main plane tabular grain | 0.55 | 0.79/30 |
| Em-L | Low-speed green-sensitive layer | (111) main plane tabular grain | 0.44 | 0.53/30 |
| Em-M | High-speed blue-sensitive layer | (111) main plane tabular grain | 1.35 | 3.50/35 |
| Em-N | Medium-speed blue-sensitive layer | (111) main plane tabular grain | 1.30 | 2.20/24 |
| Em-O | Low-speed blue-sensitive layer | (111) main plane tabular grain | 0.81 | 1.10/30 |
| Em-P | Low-speed blue-sensitive layer | (111) main plane tabular grain | 0.40 | 0.55/32 |
| Em-Q | Low-speed blue-sensitive layer | (100) main plane cubic grain | 0.21 | 0.21/20 |

| Emulsion name | Av. thickness (μm)/ VC*4 (%) | Av. aspect ratio | Ratio of tabular grains*5 (%) | Av. thickness of core portion (μm) | Annual ring structure of core portion | Number of dislocation lines per one grain |
|---|---|---|---|---|---|---|
| Em-A | 0.12/14 | 30 | 91 | 0.09 | Absence | 10≦ |
| Em-B | 0.12/14 | 18 | 97 | 0.09 | Absence | 10≦ |
| Em-C | 0.10/15 | 13 | 90 | 0.07 | Absence | 10≦ |
| Em-D | 0.09/12 | 10 | 99 | — | — | 10≦ |
| Em-E | 0.09/9.3 | 4.5 | 98 | — | — | 10≦ |
| Em-F | 0.15/13 | 9.2 | 90 | 0.12 | Presence | 10≦ |
| Em-G | 0.12/14 | 18 | 97 | 0.09 | Absence | 10≦ |
| Em-H | 0.12/14 | 30 | 91 | 0.09 | Absence | 10≦ |
| Em-I | 0.12/14 | 18 | 97 | 0.09 | Absence | 10≦ |
| Em-J | 0.10/15 | 16 | 96 | 0.07 | Absence | 10≦ |
| Em-K | 0.14/13 | 5.5 | 97 | 0.11 | Presence | 10≦ |
| Em-L | 0.17/18 | 3.2 | 97 | 0.13 | Presence | 10≦ |
| Em-M | 0.13/21 | 27 | 90 | 0.09 | Presence | 10≦ |
| Em-N | 0.34/22 | 7 | 98 | 0.14 | Absence | 10≦ |
| Em-O | 0.23/18 | 4.7 | 97 | 0.13 | Presence | 10≦ |
| Em-P | 0.13/36 | 4.6 | 96 | 0.11 | Presence | 10≦ |
| Em-Q | 0.21/20 | 1 | — | — | — | — |

*1ESD: average equivalent-sphere diameter

*2ECD: average equivalent-circular diameter

*3VC: variation coefficient

*4VC: variation coefficient

*5Ratio of tabular grains based on the total projected area occupied by all the grains (%)

TABLE 2

Composition structures of silver halide grains contained in Em-A to Em-Q

| Emulsion name | Characteristics of grains occupying 70% or more based on the total projected area | Silver amount ratio of grain structure (%) and halogen composition (listed in order from center of grain) < > indicates epitaxial junction portion |
|---|---|---|
| Em-A | (111) main plane tabular grain | (11%) AgBr/(35%) $AgBr_{97}I_3$/(18%) AgBr/(9%) $AgBr_{62}I_{38}$/(27%) AgBr |
| Em-B | (111) main plane tabular grain | (11%) AgBr/(35%) $AgBr_{97}I_3$/(18%) AgBr/(9%) $AgBr_{62}I_{38}$/(27%) AgBr |
| Em-C | (111) main plane tabular grain | (7%) AgBr/(31%) $AgBr_{97}I_3$/(16%) AgBr/(12%) $AgBr_{62}I_{38}$/(34%) AgBr |
| Em-D | (111) main plane tabular grain | (1%) AgBr/(77%) $AgBr_{99}I_1$/(9%) $AgBr_{95}I_5$/(13%) <$AgBr_{63}Cl_{35}I_2$> |
| Em-E | (111) main plane tabular grain | (57%) AgBr/(14%) $AgBr_{96}I_4$/(29%) <$AgBr_{57}Cl_{41}I_2$> |
| Em-F | (111) main plane tabular grain | (13%) AgBr/(36%) $AgBr_{97}I_3$/(7%) AgBr/(11%) $AgBr_{62}I_{38}$/(33%) AgBr |
| Em-G | (111) main plane tabular grain | (11%) AgBr/(35%) $AgBr_{97}I_3$/(18%) AgBr/(9%) AgI/(27%) AgBr |
| Em-H | (111) main plane tabular grain | (11%) AgBr/(35%) $AgBr_{97}I_3$/(18%) AgBr/(9%) AgI/(27%) AgBr |
| Em-I | (111) main plane tabular grain | (11%) AgBr/(35%) $AgBr_{97}I_3$/(18%) AgBr/(4%) AgI/(32%) AgBr |
| Em-J | (111) main plane tabular grain | (7%) AgBr/(31%) $AgBr_{97}I_3$/(15%) AgBr/(14%) $AgBr_{62}I_{38}$/(33%) AgBr |
| Em-K | (111) main plane tabular grain | (15%) AgBr/(44%) $AgBr_{97}I_3$/(11%) AgBr/(5%) AgI/(25%) AgBr |
| Em-L | (111) main plane tabular grain | (60%) AgBr/(2%) AgI/(38%) AgBr |
| Em-M | (111) main plane tabular grain | (1%) AgBr/(6%) $AgBr_{97}I_3$/(68%) $AgBr_{90}I_{10}$/(15%) AgBr/(10%) <$AgBr_{78}Cl_{20}I_2$> |
| Em-N | (111) main plane tabular grain | (8%) AgBr/(10%) $AgBr_{95}I_5$/(52%) $AgBr_{93}I_7$/(11%) AgBr/(2%) AgI/(17%) AgBr |
| Em-O | (111) main plane tabular grain | (12%) AgBr/(43%) $AgBr_{90}I_{10}$/(14%) AgBr/(2%) AgI/(29%) AgBr |
| Em-P | (111) main plane tabular grain | (58%) AgBr/(4%) AgI/(38%) AgBr |
| Em-Q | (100) main plane cubic grain | (6%) AgBr/(94%) $AgBr_{96}I_4$ |

TABLE 3

Characteristics of silver halide grains contained in Em-A to Em-Q

| Emulsion name | Av. silver iodide content (mol %)/ VC*1 of inter-grain (%) | Surface silver iodide content (mol %) | Av. silver chloride content (mol %)/ VC*1 of inter-grain (%) | Surface silver chloride content (mol %) | Twin plane spacing (μm)/ VC*1 (%) | (100) face ratio in side planes (%) | Ratio*2 of grains satisfying requirement A*3 (%) |
|---|---|---|---|---|---|---|---|
| Em-A | 4.5/10 | 3.90 | 0 | 0 | 0.011/30 | 20 | 55 |
| Em-B | 4.5/10 | 3.90 | 0 | 0 | 0.011/30 | 20 | 55 |
| Em-C | 5.5/11 | 5.00 | 0 | 0 | 0.010/30 | 30 | 75 |
| Em-D | 1.5/10 | 3.70 | 4.7/8.0 | 16 | 0.010/31 | 25 | — |
| Em-E | 1.1/11 | 5.00 | 12/9.0 | 23 | 0.009/29 | 25 | — |
| Em-F | 5.3/10 | 5.90 | 0 | 0 | 0.012/30 | 35 | 20 |
| Em-G | 4.5/10 | 3.90 | 0 | 0 | 0.011/30 | 20 | 55 |
| Em-H | 4.5/10 | 3.90 | 0 | 0 | 0.011/30 | 20 | 55 |
| Em-I | 5.1/10 | 3.90 | 0 | 0 | 0.012/30 | 20 | 60 |
| Em-J | 6.3/13 | 5.60 | 0 | 0 | 0.010/30 | 30 | 65 |
| Em-K | 6.3/22 | 7.39 | 0 | 0 | 0.016/32 | 20 | 15 |
| Em-L | 2.0/14 | 5.68 | 0 | 0 | 0.016/32 | 35 | 18 |
| Em-M | 7.1/10 | 3.80 | 5.4/8.0 | 10 | 0.012/30 | 30 | 85 |
| Em-N | 6.1/8.0 | 5.50 | 0 | 0 | 0.017/33 | 20 | 20 |
| Em-O | 6.3/9.0 | 1.90 | 0 | 0 | 0.019/30 | 30 | 15 |
| Em-P | 4.0/10 | 5.50 | 0 | 0 | 0.020/31 | 30 | 20 |
| Em-Q | 3.8/9.0 | 4.50 | 0 | 0 | — | — | — |

*1VC: variation coefficient
*2Ratio of grains satisfying requirement A to all grains in number (%)
*3It is a silver iodobromide grain or a silver iodochlorobromide grain having a (111) main plane in which an equivalent-circular diameter is 1.0 μm or more and the grain thickness is 0.15 μm or less, the grain having 10 or more dislocation lines. Further, the grain has a core portion having a thickness of 0.1 μm or less in which the core portion comprises silver iodobromide and does not contain an annual ring structure.

TABLE 4

Sensitizing dye and dopant used in Em-A to Em-O

| Emulsion name | Layer used | Sensitizing dye | Dopant |
|---|---|---|---|
| Em-A | High-speed red-sensitive layer | 2, 3, 14 | $K_2IrCl_6$, $K_4Ru(CN)_6$ |
| Em-B | Medium-speed red-sensitive layer | 2, 3, 14 | $K_2IrCl_6$, $K_4Ru(CN)_6$ |
| Em-C | Medium and low-speed red-sensitive layers | 1, 2, 3 | $K_2IrCl_6$, $K_2IrCl_5(H_2O)$, $K_4Ru(CN)_6$ |
| Em-D | Low-speed red-sensitive layer | 2, 3, 14 | $K_2IrCl_6$, $K_4Fe(CN)_6$ |
| Em-E | Low-speed red-sensitive layer | 2, 3, 14 | $K_2IrCl_6$, $K_4Fe(CN)_6$ |
| Em-F | Layer for donating interlayer effect to red-sensitive layer | 7, 8 | $K_4Fe(CN)_6$ |
| Em-G | Layer for donating interlayer effect to red-sensitive layer | 7, 8 | $K_4Fe(CN)_6$ |
| Em-H | High-speed green-sensitive layer | 5, 6, 8 | $K_4Ru(CN)_6$ |
| Em-I | Medium-speed green-sensitive layer | 4, 5, 6, 8 | $K_2IrCl_6$, $K_4Ru(CN)_6$ |
| Em-J | Medium and low-speed green-sensitive layers | 4, 5, 6, 8 | $K_2IrCl_6$, $K_4Fe(CN)_6$ |
| Em-K | Low-speed green-sensitive layer | 4, 5, 6, 8, 13 | $K_2IrCl_6$ |
| Em-L | Low-speed green-sensitive layer | 6, 8, 13 | $K_2IrCl_6$, $K_4Fe(CN)_6$ |
| Em-M | High-speed blue-sensitive layer | 16 | — |
| Em-N | Medium-speed blue-sensitive layer | 16 | — |
| Em-O | Low-speed blue-sensitive layer | 9 | — |
| Em-P | Low-speed blue-sensitive layer | 9, 15 | — |
| Em-Q | Low-speed blue-sensitive layer | 12, 25 | $K_2IrCl_6$ |

Emulsions Em-A and H were prepared referring to the preparation process of emulsion 1-H described in Example of JP-A-2002-268162.

Emulsions Em-B to C, G, I to J and N were prepared referring to the preparation process of emulsion 1-F described in Example of JP-A-2002-268162.

Emulsions Em-F, K to L and O to P were prepared referring to the preparation process of emulsion 1-D described in Example of JP-A-2002-268162.

Emulsions Em-D to E were prepared referring to the preparation process of emulsion described in Example of JP-A-2002-278007.

Emulsion Em-M was prepared referring to the preparation process described in Examples Em-4 and Em-5 of JP-A-2004-37936.

Emulsion Em-Q was prepared referring to the preparation process described in Example Em-N of JP-A-2002-72429.

Emulsions Em-M to Q were sensitized by reduction at preparation of particles.

The optimum amount of spectral sensitization dyes described in Table 4 was added to the emulsions and gold sensitization, sulfur sensitization and selenium sensitization were optimally carried out.

The sensitizing dyes used in examples of the present invention will be described below.
Sensitizing dye 1
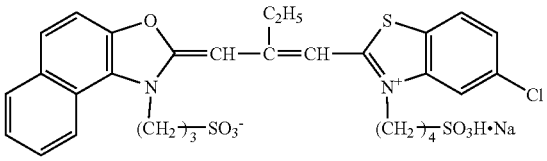
Sensitizing dye 2
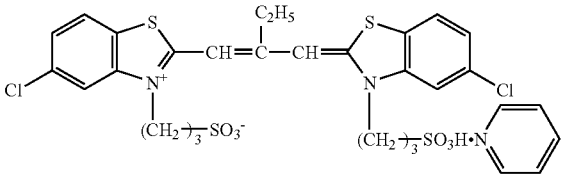
Sensitizing dye 3
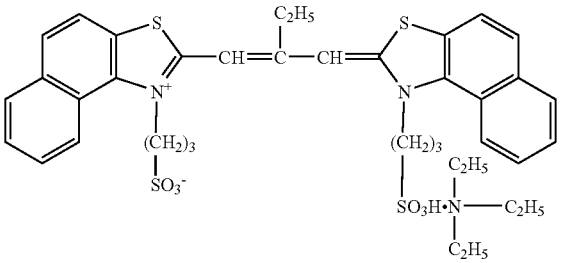
Sensitizing dye 4
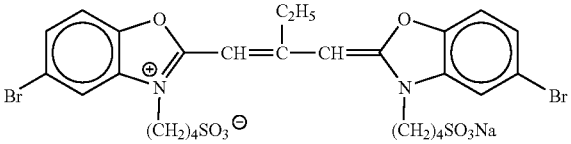
Sensitizing dye 5
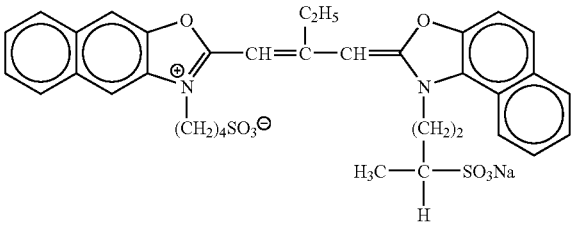
Sensitizing dye 6
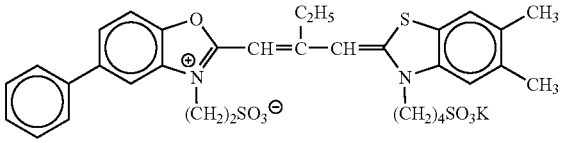
Sensitizing dye 7
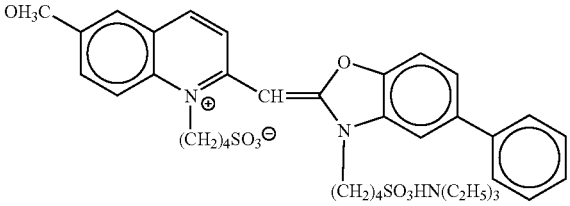
-continued
Sensitizing dye 8
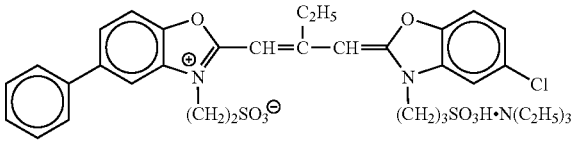
Sensitizing dye 9
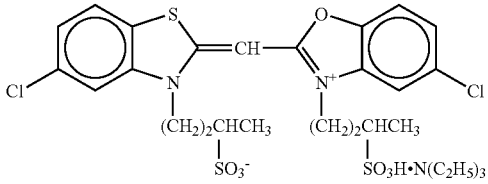
Sensitizing dye 12
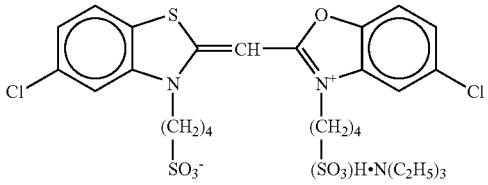
Sensitizing dye 13
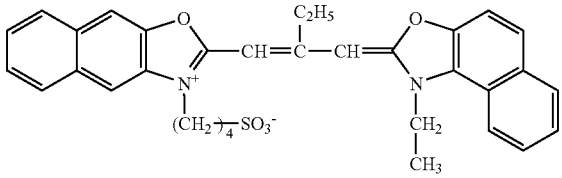
Sensitizing dye 14
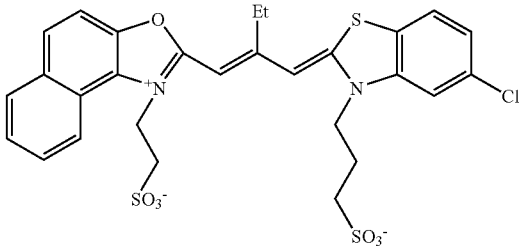
Sensitizing dye 15
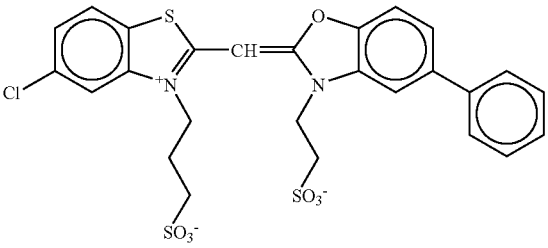
Sensitizing dye 16
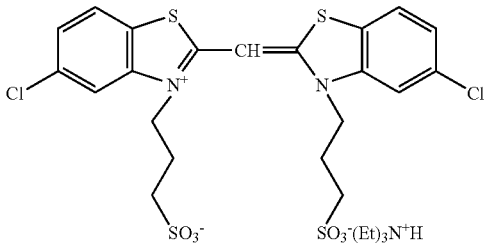

Other compounds used in examples of the present invention will be described below.
ExC-1
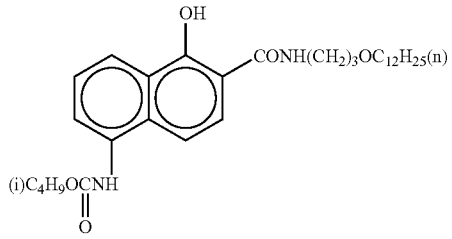
ExC-2
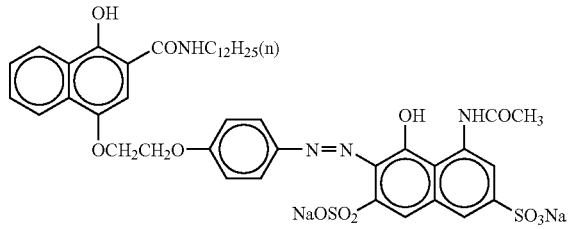
ExC-3
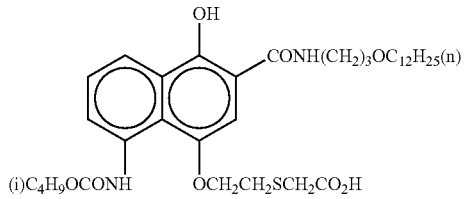
ExC-4
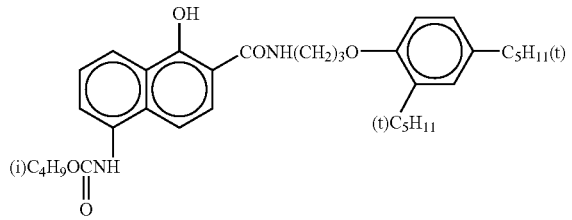
ExC-5
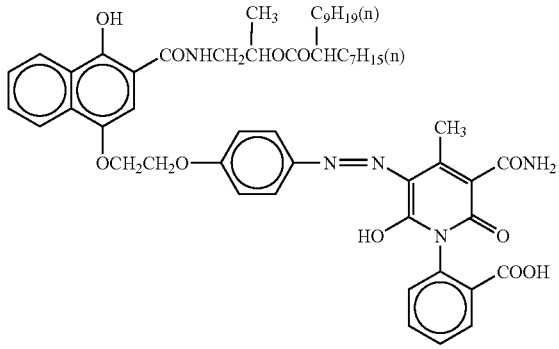
ExC-6
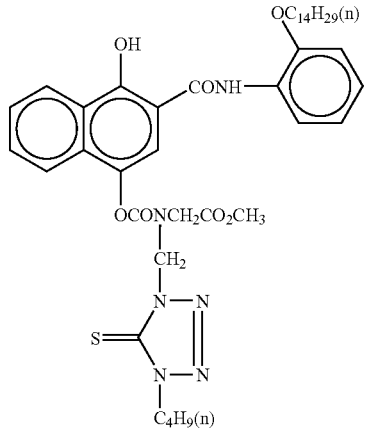
ExC-7
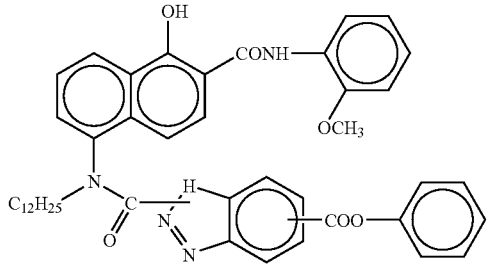
ExC-8
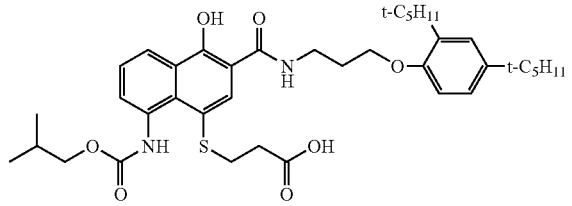
ExC-9
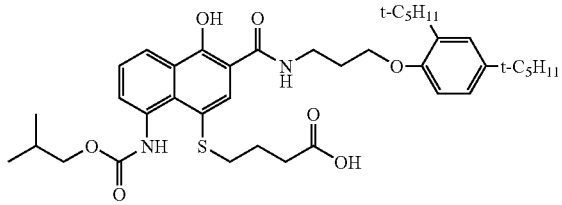
ExC-10
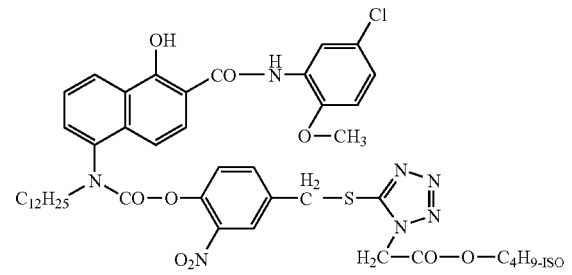

-continued
ExM-1
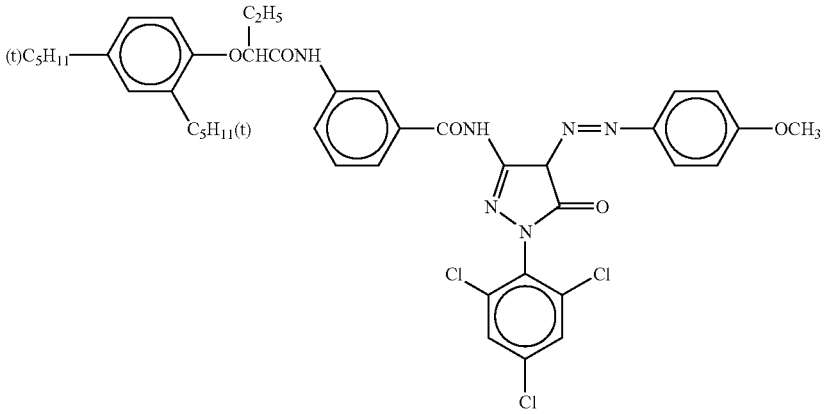
ExM-2
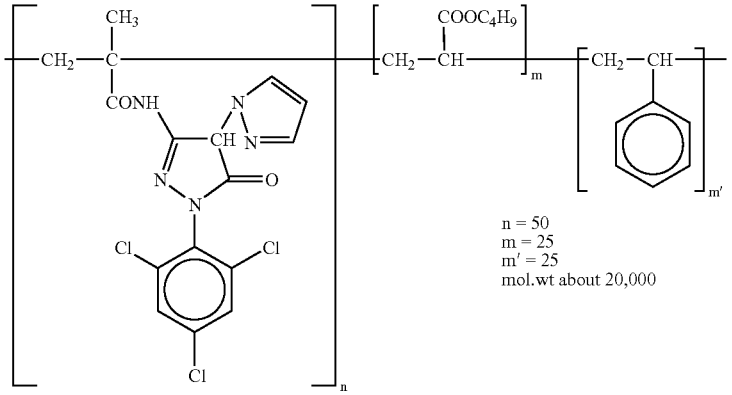
ExM-3
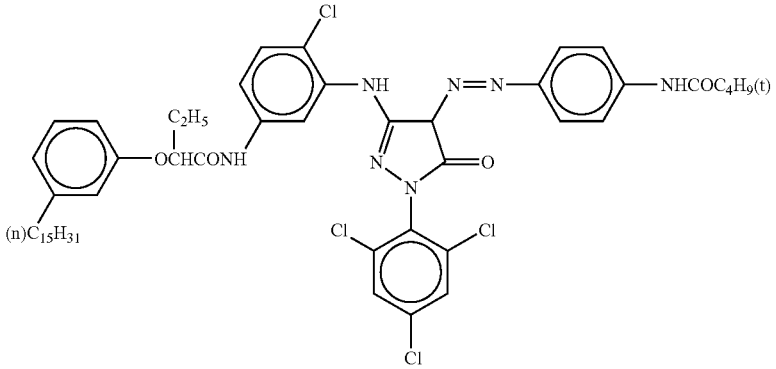
ExM-4
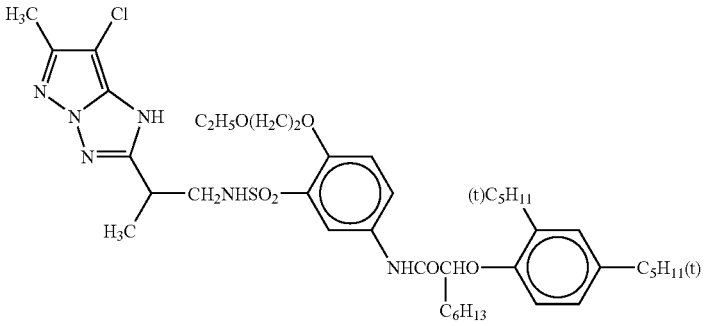

-continued
ExM-5
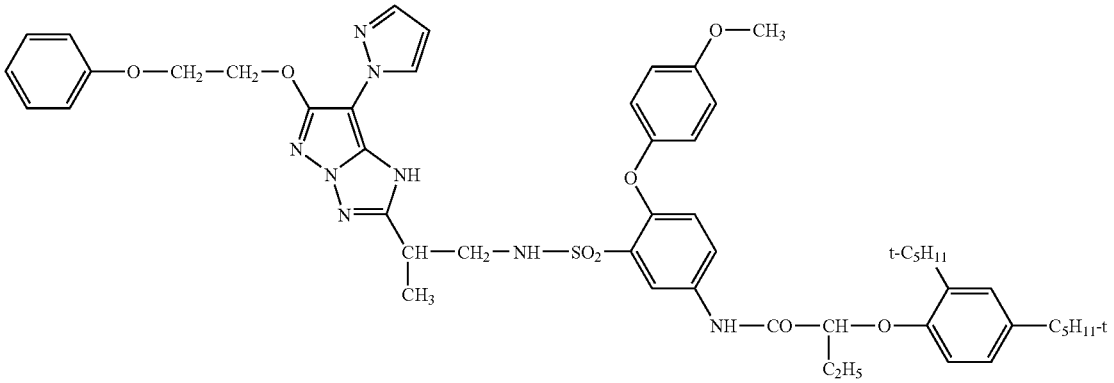
ExM-6
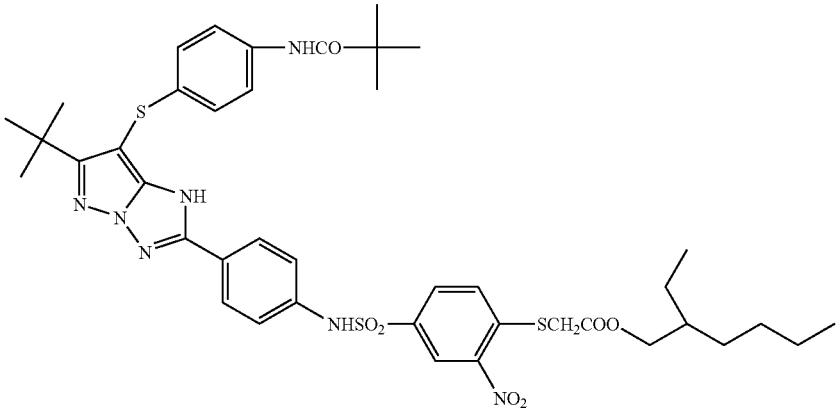
ExY-1
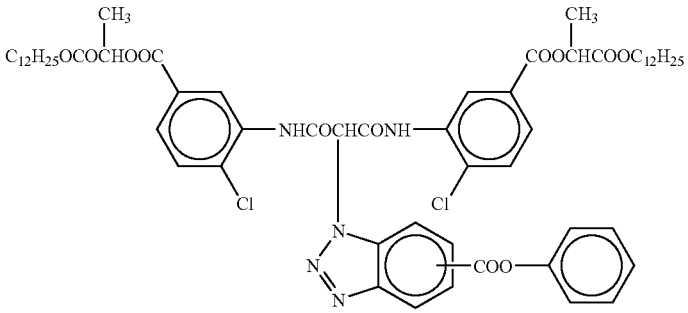
ExY-2
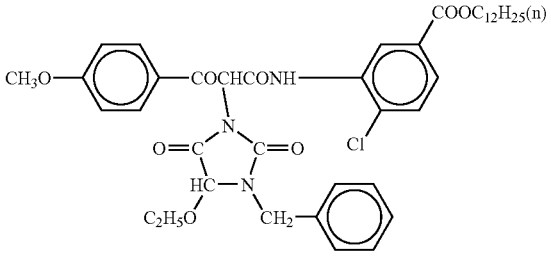
ExY-3
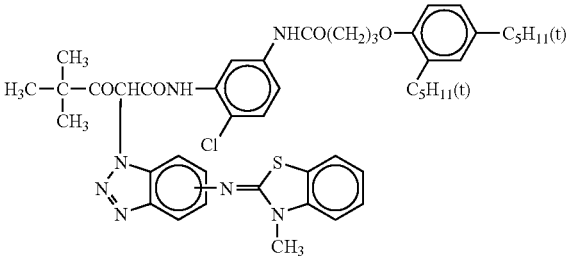

-continued
ExY-4
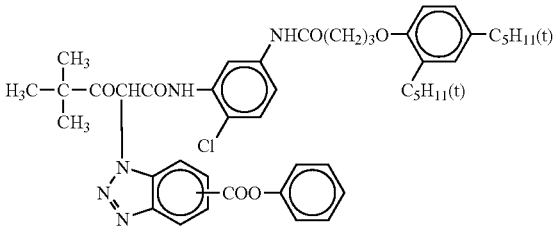
ExY-5
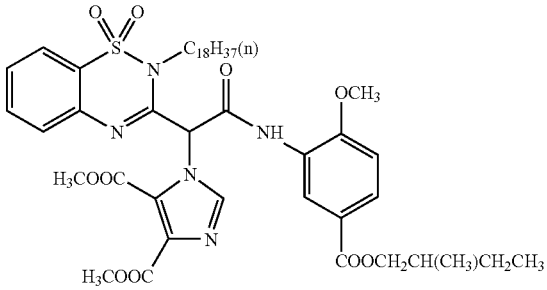
Cpd-1
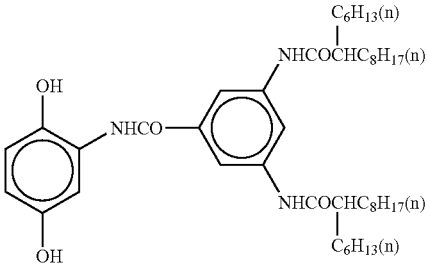
Cpd-2
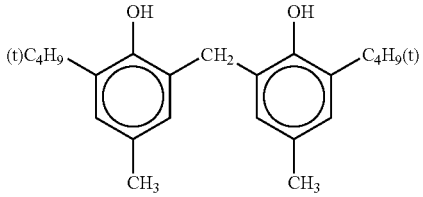
Cpd-3
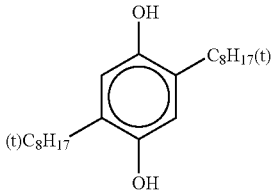
Cpd-4
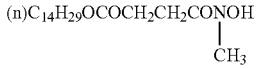
Cpd-5
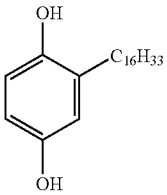
Cpd-6
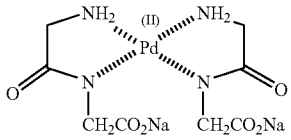
Cpd-7
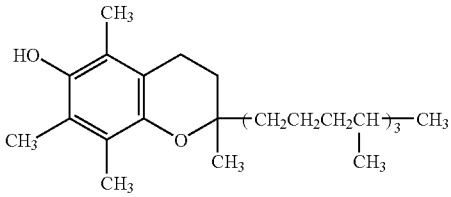
Cpd-8
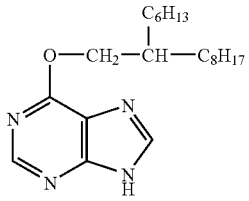
Cpd-9
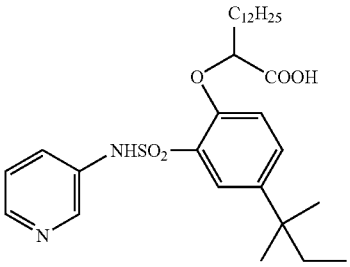
UV-1
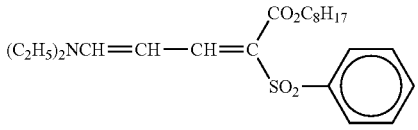

-continued

UV-2

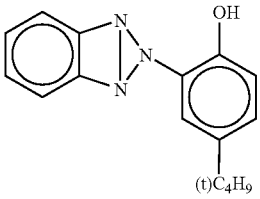

UV-3

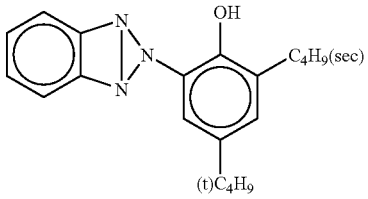

UV-4

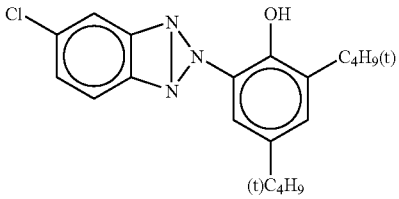

UV-5

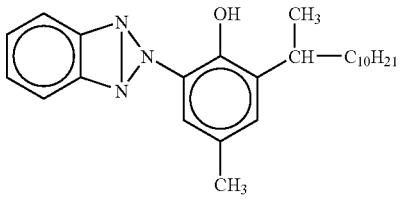

B-1

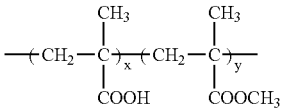

x/y = 10/90 (mass ratio)
Weight-average molecular weight: about 35,000

B-2

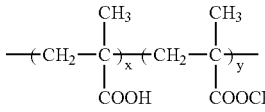

x/y = 40/60 (mass ratio)
Weight-average molecular weight: about 20,000

B-3

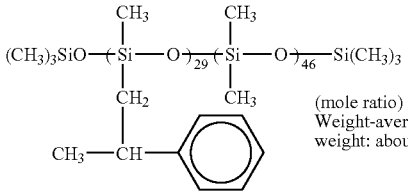

(mole ratio)
Weight-average molecular weight: about 8,000

B-4

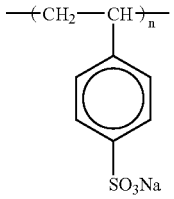

Weight-average molecular weight: about 750,000

B-5

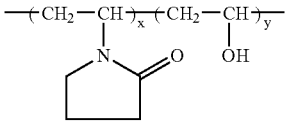

x/y = 70/30 (mass ratio)
Weight-average molecular weight: about 17,000

B-6

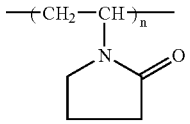

Weight-average molecular weight: about 10,000

HBS-1

Tricresyl phosphate

HBS-2

Di-n-butyl phthalate

HBS-3

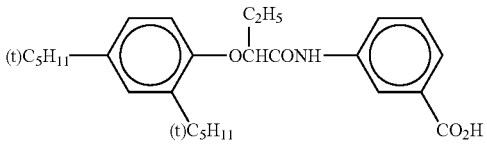

HBS-4

Tri (2-ethylhexyl) phosphate

HBS-5

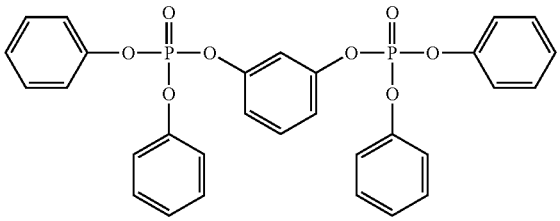

S-1

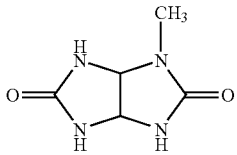

-continued
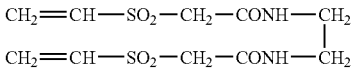
H-1
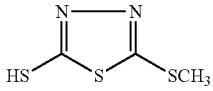
F-1
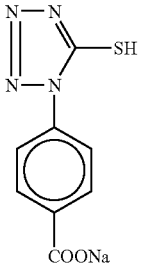
F-2
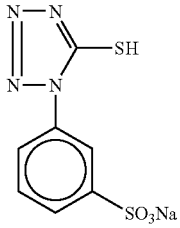
F-3
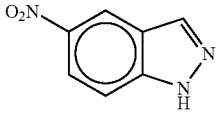
F-4
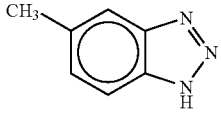
F-5
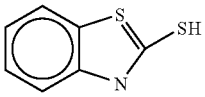
F-6
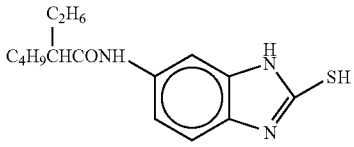
F-7
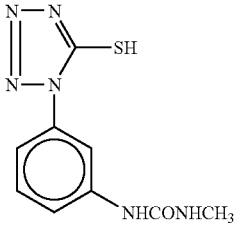
F-8
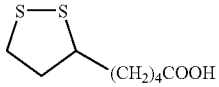
F-9
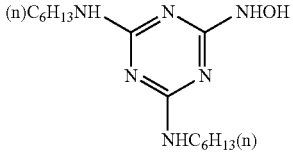
F-10
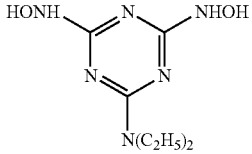
F-11
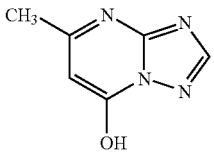
F-12
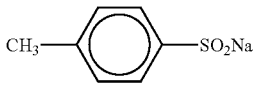
F-13
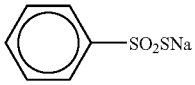
F-14
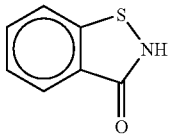
F-15
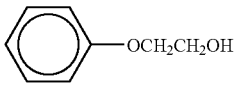
F-16
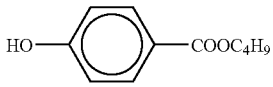
F-17

-continued
F-18
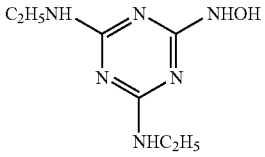
F-19
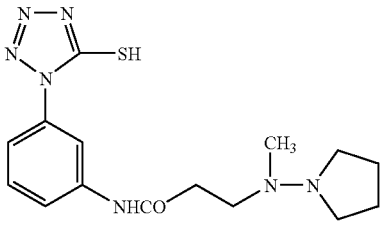
W-1
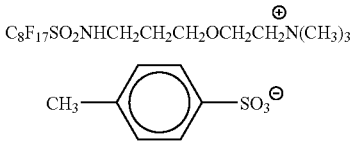
W-2
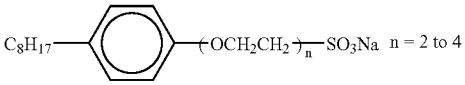
W-3
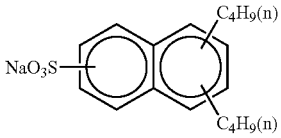
W-4
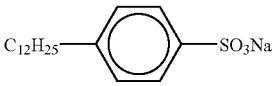
W-5
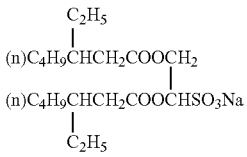
W-6
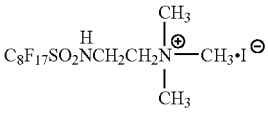
W-7
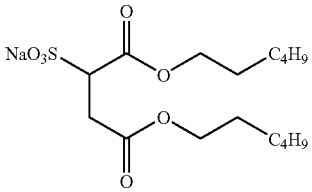
W-8
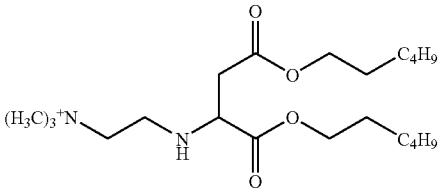
W-9
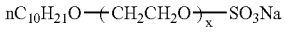
x = 1 to 3
W-10
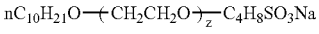
z = 1 to 3
W-11
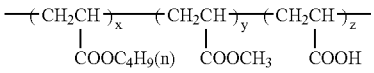
x/y/z = 20/60/20 (mass ratio)
Weight-average molecular
weight about 36,000
W-12
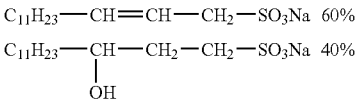
W-13
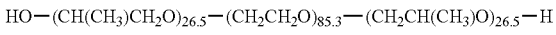
ExF-1
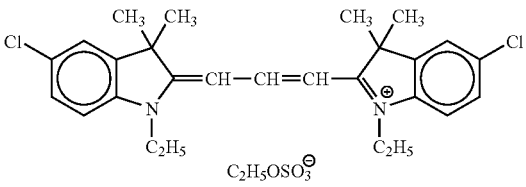

-continued
ExF-2
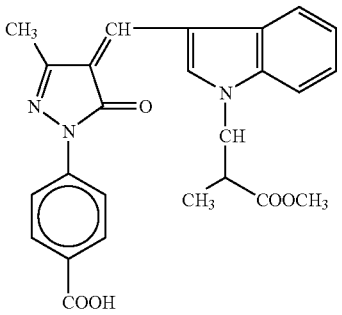
ExF-4
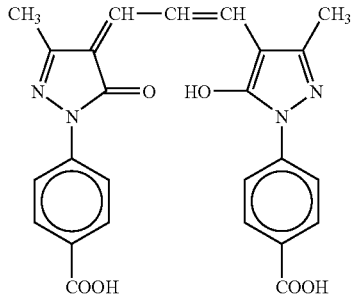
ExF-5
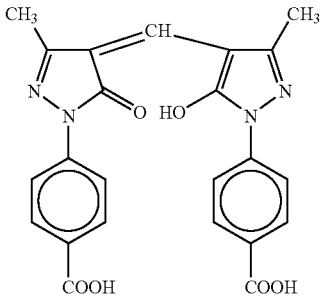
ExF-6
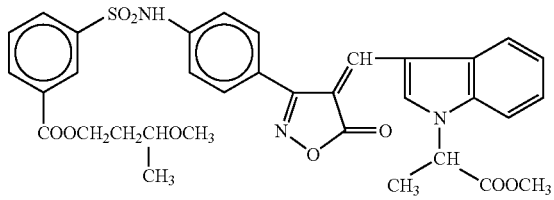
ExF-7
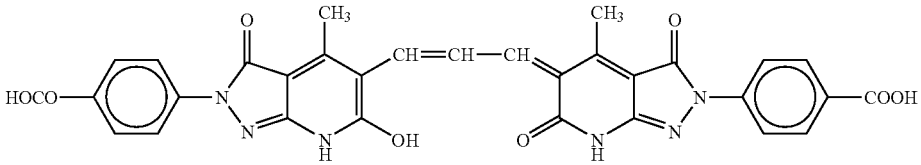
ExF-8
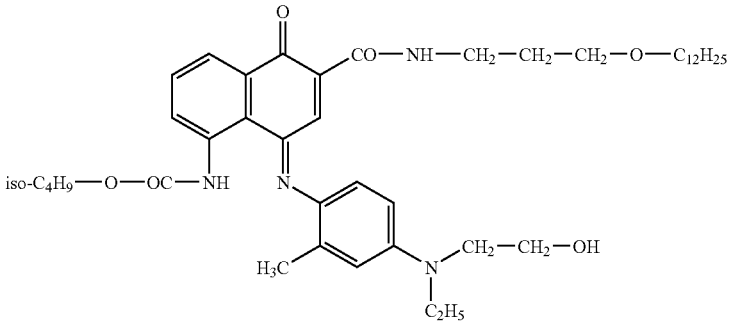
ExF-9
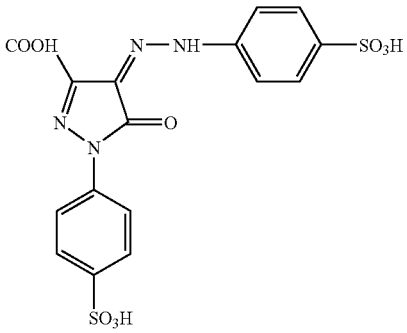
ExF-10
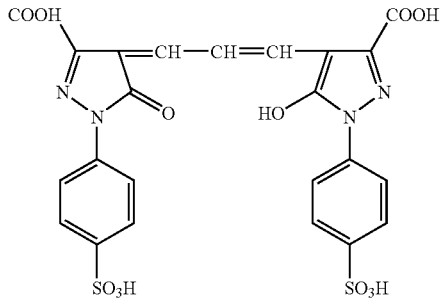

-continued

ExF-11

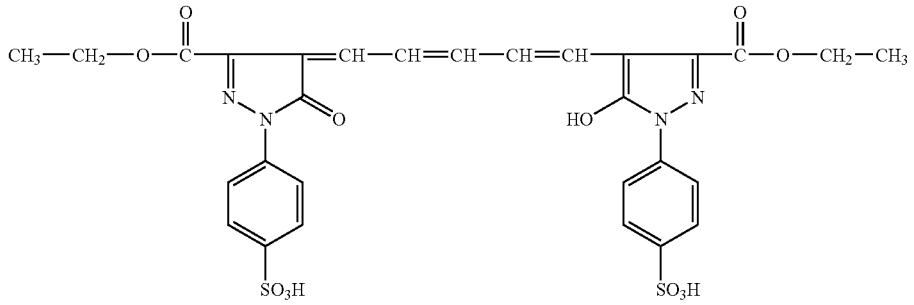

Comparative compound-1

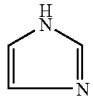

The above-mentioned silver halide color photosensitive material is referred to as the sample 101.

As sensitometry, ISO sensitivity which is the international standard is generally used at determining specific sensitivity in the industry but it is prescribed in the ISO sensitivity that the development of a photosensitive material is carried out at the $5^{th}$ day after exposure and development processing is according to the assignment of respective companies.

In the present invention, time until development processing after exposure is shortened and the fixed development processing was designed to be carried out. The determining method is substantially in accordance with JIS K 7614-1981 except that the development processing is completed within 30 min to 6 hr after exposure for sensitometry and that the development processing is performed according to Fuji Color standard processing recipe CN-16.

Sample 101 was exposed through, manufactured by Fuji Photo Film Co., Ltd., gelatin filter SC-39 and continuous wedge for 1/100 sec.

The samples after the exposure were processed in the following manner.

(Processing Procedure)

| Step | Processing time | Processing temp. |
|---|---|---|
| Color development: | 3 min 15 sec | 38° C. |
| Bleaching: | 3 min 00 sec | 38° C. |
| Washing: | 30 sec | 24° C. |
| Fixing: | 3 min 00 sec | 38° C. |
| Washing (1): | 30 sec | 24° C. |
| Washing (2): | 30 sec | 24° C. |
| Stabilization: | 30 sec | 38° C. |
| Drying: | 4 min 20 sec | 55° C. |

The composition of the processing solution for use in each of the above steps is as follows:

| | (Unit: g) |
|---|---|
| (Color developer) | |
| Diethylenetriaminepentaacetic acid | 1.0 |
| l-Hydroxyethylidene-1,1-diphosphonic acid | 2.0 |

-continued

| | (Unit: g) |
|---|---|
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water | q.s. ad 1.0 L |
| pH (adjusted with potassium hydroxide and sulfuric acid) | 10.05. |
| (Bleaching solution) | |
| Ethylenediaminetetraacetic acid ferric ammonium trihydrate salt | 100.0 |
| Ethylenediaminetetraacetic acid disodium salt | 10.0 |
| 3-Mercapto-1,2,4-triazole | 0.03 |
| Ammonium bromide | 140.0 |
| Ammonium nitrate | 30.0 |
| Aq. ammonia (27%) | 6.5 mL |
| Water | q.s. ad 1.0 L |
| pH (adjusted with aq. ammonia and nitric acid) | 6.0. |
| (Fixer) | |
| Ethylenediaminetetraacetic acid disodium salt | 0.5 |
| Ammonium sulfite | 20.0 |
| Aq. soln. of ammonium thiosulfate (700 g/L) | 295.0 mL |
| Acetic acid (90%) | 3.3 |
| Water | q.s. ad 1.0 L |
| pH (adjusted with aq. ammonia and nitric acid) | 6.7 |
| (Stabilizer) | |
| p-Nonylphenoxypolyglycidol (glycidol av. polymn. deg. 10) | 0.2 |
| Ethylenediaminetetraacetic acid | 0.05 |
| 1,2,4-Triazole | 1.3 |
| 1,4-Bis(1,2,4-triazol-l-ylmethyl)piperazine | 0.75 |
| Hydroxyacetic acid | 0.02 |
| Hydroxyethylcellulose (Daicel Chemical Industries, Ltd. HEC SP-2000) | 0.1 |
| 1,2-Benzoisothiazolin-3-one | 0.05 |
| Water | q.s. ad 1.0 L |
| pH | 8.5. |

The specified photographic speed of sample 101 determined by the above-mentioned method was ISO 3200.

Samples 102 to 109 were prepared in like manner as the sample 101 except that compound (A) of the invention or comparative compound-1 were emulsified with couplers of each layers and then added to the $4^{th}$, $5^{th}$, $6^{th}$, $8^{th}$, $9^{th}$, $10^{th}$, 11th, 13th, 14th, and 15th layers as described in Table 5, and the compound selected from the type 1 and 2 was added to emulsions Em-A, H and M to N as described in Table 5.

The samples 101 to 109 were exposed through, manufactured by Fuji Photo Film Co., Ltd., gelatin filter SC-39 and continuous wedge for 1/100 sec.

The sensitivity of red-sensitive layer, green-sensitive layer and blue-sensitive layer was defined as the logarithm of inverse number of exposure intensity required for cyan, magenta and yellow color image densities, respectively, to be minimum density+0.5, and expressed as the difference from that of the sample 101.

The graininess thereof was estimated by determining the RMS granularity of cyan, magenta and yellow color images at a density of fog+0.5 and expressed by the relative value providing that the graininess of the sample 101 was 100.

For estimation of any substantial sensitivity enhancement, when the RMS granularity changed in accordance with sensitivity increase, comparison was made while effecting RMS granularity matching through regulation of the amount of ExY-3 in the 4th, 5th, 6th, 8th, 9th, 10th, 11th, 13th, 14th and 15th layers.

The storability was estimated by determining the difference between the fog density measured after allowing a raw sample to stand still in compulsory deterioration conditions of 80° C. 10% for 20 hours and that measured without placing a raw sample in such compulsory deterioration conditions. The smaller the difference value, the preferably less the fog increase by aging.

TABLE 5

| Sample No. | Compound (A) [Additive amount]*1 | Compound of type 1 or 2 [Additive amount]*1 | Sensitivity | | | Graininess | | | storability | | |
|---|---|---|---|---|---|---|---|---|---|---|---|
| | | | Red*2 | Green*2 | Blue*2 | Red2* | Green2* | Blue2* | Red2* | Green2* | Blue2* |
| 101 Comp. | — | — | 0.00 | 0.00 | 0.00 | 100 | 102 | 100 | 0.10 | 0.08 | 0.08 |
| 102 Comp. | Comparative compound-1 [10 × 10⁻³] | — | 0.04 | 0.04 | 0.04 | 101 | 101 | 100 | 0.22 | 0.20 | 0.21 |
| 103 Inv. | C-1 [10 × 10⁻³] | — | 0.04 | 0.05 | 0.04 | 99 | 101 | 98 | 0.10 | 0.08 | 0.09 |
| 104 Inv. | C-11 [10 × 10⁻³] | — | 0.05 | 0.04 | 0.05 | 100 | 99 | 100 | 0.10 | 0.07 | 0.08 |
| 105 Inv. | C-15 [10 × 10⁻³] | — | 0.04 | 0.04 | 0.05 | 200 | 99 | 101 | 0.11 | 0.08 | 0.08 |
| 106 Inv. | C-13 [10 × 10⁻³] | — | 0.05 | 0.04 | 0.05 | 99 | 98 | 101 | 0.09 | 0.07 | 0.08 |
| 107 Inv. | C-13 [10 × 10⁻³] | 37 [5 × 10⁻⁶] | 0.06 | 0.05 | 0.08 | 98 | 100 | 98 | 0.09 | 0.07 | 0.06 |
| 108 Inv. | C-13 [10 × 10⁻³] | 7 [5 × 10⁻⁶] | 0.06 | 0.06 | 0.10 | 98 | 98 | 99 | 0.09 | 0.07 | 0.06 |
| 109 Inv. | C-1 [10 × 10⁻³] | 37 [5 × 10⁻⁶] | 0.05 | 0.06 | 0.07 | 100 | 98 | 98 | 0.10 | 0.08 | 0.06 |

*1mol/mol Ag
*2Red: Red-sensitive layer, Green: Green-sensitive layer, Blue: Blue-sensitive layer As apparent front the above, the light-sensitive material of the present invention ensures high sensitivity, and further excellent storability.

EXAMPLE 2

Each of samples 201 to 209 was prepared in like manner as the samples 101 to 109 described in Example 1 except that the support was changed to a support shown below, and when evaluation was carried out in like manner as the method of Example 1, the sample of the invention exhibited also preferable result in the Example.

(i) First Layer and Undercoat Layer

Glow discharge was performed on the two surfaces of a 90-μm thick polyethylenenaphthalate support at a processing ambient pressure of 26.6 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

| | |
|---|---|
| Conductive fine-grain dispersion (a water dispersion having an $SnO_2/Sb_2O_5$ grain concentration of 10%, a secondary aggregate having a primary grain size of 0.005 μm and an average grain size of 0.05 μm) | 50 parts by mass |
| Gelatin | 0.5 parts by mass |
| Water | 49 parts by mass |
| Polyglycerolpolyglycidyl ether | 0.16 parts by mass |
| Poly (polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly (polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by mass of a Co-deposited $\gamma$-$Fe_2O_3$ magnetic substance (average long axis length: 0.25 μm, $S_{BET}$: 39 $m^2/g$, Hc: $6.56\times10^4$ A/m, σs: 77.1 $Am^2/kg$, σr: 37.4 $Am^2/kg$), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (¼ G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (Average Primary Grain Size 1.5 μm, Specific Surface Area 1.3 $m^2/g$)

Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K. K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 $mL/m^2$ by using a wire bar. The solution was dried at 110° C. The thickness of the dried magnetic layer was 1.0 μm.

(iii) Third Layer (Higher Fatty Acid Ester Slipping Agent-containing Layer)

(1) Formation of Undiluted Dispersion

A solution A presented below was dissolved at loot and added to a solution B. The resultant solution mixture was dispersed by a high-pressure homogenizer to form an undiluted dispersion of a slipping agent.

| | |
|---|---|
| **Solution A** | |
| Compound below $C_6H_{13}CH(OH)(CH_2)_{10}COOC_{50}H_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| **Solution B** | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 1-1: $(CH_3O)_3Si—(CH_2)_3—NH_2$) | 5.53 parts by mass |
| Compound 1 | 2.93 parts by mass |
| 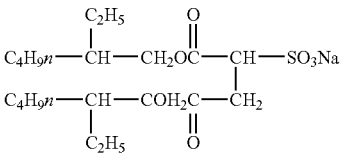 | Compound 1 |
| SEAHOSTAR KEP50 (amorphous spherical silica, average grain size 0.5 μm, manufactured by NIPPON SHOKUBAI Co., Ltd.) | 88.00 parts by mass |

The above formulation was stirred for 10 min, and the following was further added.

| | |
|---|---|
| Diacetone alcohol | 252.93 parts by mass |

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 μm) | 60 parts by mass |
| Methylethylketone | 120 parts by mass |
| Cyclohexanone (solid content 20%, solvent: methylethylketone/cyclohexanone = 1/1) | 120 parts by mass |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |

-continued

| | |
|---|---|
| Above-mentioned spherical organic polymer grain dispersion [c2] | 300 g |
| FC431 (manufactured by 3M K. K., solid content 50%, solvent: ethyl acetate) | 2.65 g |
| BYK310 (manufactured by BYK Chemi Japan K. K., solid content 25%) | 5.3 g |

The above third layer coating solution was coated in an amount of 10.35 mL/$m^2$ on the second layer, dried at 110° C., and further dried at 97° C. for 3 min.

EXAMPLE 3

When a photochromatic filter described in Example 1 of JP-A-2004-170613 was used for the samples 101 to 109 described in Example 1 and the samples 201 to 209 described in Example 2 of the above-mentioned invention, appropriate exposure level could be maintained by the photochromatic filter and a "fault photo" could be helped.

What is claimed is:

1. A silver halide color photosensitive material comprising a support and, superimposed thereon, a blue-sensitive layer unit, a green-sensitive layer unit and a red-sensitive layer unit, each of these light-sensitive layer units composed of at least one silver halide emulsion layer, together with at least one non-sensitive layer, wherein compound (A) is contained in at least one layer in the silver halide color photosensitive material, compound (A) being a compound capable of releasing compound (Ac1) by oxidation coupling reaction with a color developing agent, compound (Ac1) being a hetero cyclic compound which when added, is capable of enhancing the sensitivity of the photosensitive material as compared with that exhibited when not added, provided that the heterocyclic ring of the heterocyclic compound has 1 or 2 hetero atoms.

2. The silver halide color photosensitive material according to claim 1, wherein compound (A) is an active methylene compound, a pyrazolone compound, a pyrazoloazole compound, a phenol compound, a naphthol compound or a pyrrolotriazole compound.

3. The silver halide color photosensitive material according to claim 1, wherein, the heterocyclic ring of compound (Ac1) is an imidazole ring.

4. The silver halide color photosensitive material according to claim 2, wherein the heterocyclic ring of compound (Ac1) is an imidazole ring.

5. The silver halide color photosensitive material according to claim 1, wherein a compound selected from the following type 1 and the type 2 is contained in at least one layer in the photosensitive material (Type 1)

Compound which undergoes a one-electron oxidation so as to form a one-electron oxidation product capable of, through subsequent bond cleavage reaction, releasing one or more electrons (Type 2)

Compound which undergoes a one-electron oxidation so as to form a one-electron oxidation product capable of, after subsequent bond formation reaction, releasing one or more electrons.

6. The silver halide color photosensitive material according to claim 2, wherein a compound selected from the following type 1 and the type 2 is contained in at least one layer in the photosensitive material (Type 1)

Compound which undergoes a one-electron oxidation so as to form a one-electron oxidation product capable of, through subsequent bond cleavage reaction, releasing one or more electrons (Type 2)

Compound which undergoes a one-electron oxidation so as to form a one-electron oxidation product capable of, after subsequent bond formation reaction, releasing one or more electrons.

7. The silver halide color photosensitive material according to claim 3, wherein a compound selected from the following type 1 and the type 2 is contained in at least one layer in the photosensitive material (Type 1)

Compound which undergoes a one-electron oxidation so as to form a one-electron oxidation product capable of, through subsequent bond cleavage reaction, releasing one or more electrons (Type 2)

Compound which undergoes a one-electron oxidation so as to form a one-electron oxidation product capable of, after subsequent bond formation reaction, releasing one or more electrons.

8. The silver halide color photosensitive material according to claim 4, wherein a compound selected from the following type 1 and the type 2 is contained in at least one layer in the photosensitive material (Type 1)

Compound which undergoes a one-electron oxidation so as to form a one-electron oxidation product capable of, through subsequent bond cleavage reaction, releasing one or more electrons (Type 2)

Compound which undergoes a one-electron oxidation so as to form a one-electron oxidation product capable of, after subsequent bond formation reaction, releasing one or more electrons.

* * * * *